US005694145A

United States Patent [19]

Kondo et al.

[11] Patent Number: 5,694,145

[45] Date of Patent: Dec. 2, 1997

[54] LIQUID CRYSTAL DEVICE AND DRIVING METHOD THEREFOR

[75] Inventors: Shigeki Kondo, Hiratsuka; Shigetoshi Sugawa, Atsugi; Tetsunobu Kohchi, Hiratsuka, all of Japan

[73] Assignee: Canon Kabushiki Kaisha, Tokyo, Japan

[21] Appl. No.: 353,391

[22] Filed: Dec. 2, 1994

Related U.S. Application Data

[63] Continuation of Ser. No. 972,386, Nov. 5, 1992, abandoned.

[30] Foreign Application Priority Data

| | | | |
|---|---|---|---|
| Nov. 7, 1991 | [JP] | Japan | 3-318622 |
| Nov. 7, 1991 | [JP] | Japan | 3-318623 |
| Dec. 10, 1991 | [JP] | Japan | 3-349776 |

[51] Int. Cl.[6] ..... G09G 3/36

[52] U.S. Cl. ..... 345/90; 345/98; 345/100

[58] Field of Search ..... 345/90, 92, 94, 345/95, 98–100, 101, 93; 359/54, 57, 84, 85; 349/33, 34

[56] References Cited

U.S. PATENT DOCUMENTS

| | | | |
|---|---|---|---|
| 4,651,148 | 3/1987 | Takeda et al. | 340/811 |
| 4,795,239 | 1/1989 | Yamashita et al. . | |
| 4,803,480 | 2/1989 | Soneda et al. | 340/784 |
| 4,818,077 | 4/1989 | Ohwada et al. . | |
| 4,840,462 | 6/1989 | Hartmann . | |
| 4,909,602 | 3/1990 | Kaneko et al. | 345/92 |
| 4,973,135 | 11/1990 | Okada et al. . | |
| 5,014,048 | 5/1991 | Knapp | 340/784 |
| 5,105,288 | 4/1992 | Senda et al. | 340/784 |
| 5,113,181 | 5/1992 | Inoue et al. | 340/783 |

FOREIGN PATENT DOCUMENTS

| | | |
|---|---|---|
| 0284134 | 9/1988 | European Pat. Off. . |
| 0313876 | 5/1989 | European Pat. Off. . |

OTHER PUBLICATIONS

Proc. Soc. Info. Disp., vol. 30, No. 2, 1989, pp. 99–103, Hartmann, "Ferroelectric Liquid–Crystal Video Display".

Proc. SID, vol. 32, No. 4, 1991, pp. 331–337, Hori, "Key Issues Regarding High–Information–Content TFT–LCDs for Data Graphics".

IEEE Trans. Electron Dev., vol. 36, No. 9I, Sep. 1989, pp. 1938–1942, Howard et al."Eliminating Crosstalk in Thin–Film Transistor/Liquid–Crystal Displays".

*Primary Examiner*—Steven Saras

*Attorney, Agent, or Firm*—Fitzpatrick, Cella, Harper & Scinto

[57] ABSTRACT

A liquid crystal device of active matrix type includes a layer of a liquid crystal material and a plurality of unit cells each provided with an active element. The device further includes signal lines for supplying signals for determining an optical state of the liquid crystal material, and a circuit for maintaining the signal lines at a certain reference potential during a period other than a period in which signals are supplied to the unit cells.

2 Claims, 24 Drawing Sheets

LIQUID CRYSTAL DEVICE AND DRIVING METHOD THEREFOR

This application is a continuation, of application Ser. No. 07/972,386 filed Nov. 5, 1992, now abandoned.

BACKGROUND OF THE INVENTION

1. Field of the Invention

The present invention relates to a liquid crystal device adapted for use in an image information processing apparatus such as a flat panel display, a projection television or a video recorder, or the like, and a driving method therefor.

2. Related Background Art

Liquid crystal devices, particularly so-called active matrix liquid crystal display devices employing active elements as the pixel switches, have been widely utilized, principally employing twisted nematic (TN) liquid crystal, and commercialized in the fields of flat panel displays and projection televisions. The above-mentioned active matrix element, represented by a thin film transistor (TFT), a thin film diode and an MIM (metal-insulator-metal) element is used for assisting the optical switching response of liquid crystal by maintaining a voltage application state for a period longer than the actual line selecting period for the TN liquid crystal of a relatively slow response, and realizing a practical memory state for a frame period, by the above-mentioned voltage application state, in liquid crystal lacking the memory property (self-holding property) such as the TN liquid crystal mentioned above. Also the configuration utilizing such active matrix elements is in principle free from crosstalk among the lines or the pixels, thus providing satisfactory display characteristics.

In recent years there has been developed ferroelectric liquid crystal (FLC) with a response speed which is several orders higher than that of the TN liquid crystal, and the developments of a display panel, a light valve etc. utilizing such FLC have been announced. There is a possibility of obtaining a further improved display device by driving the FLC with the above-mentioned active matrix elements, and the combination of FLC and the above-mentioned TFT is already disclosed for example in the U.S. Pat. No. 4,840,462 and in the Proceedings of the SID, vol. 30, 1989 "Ferroelectric Liquid-Crystal Video Display".

FIG. 1 is a circuit diagram of such a conventional active matrix liquid crystal device.

The driving unit of said device is composed of pixels parts each consisting of a liquid crystal cell 701, containing liquid crystal sealed between a common electrode (with a potential $V_{COM}$) and an individual pixel electrode, and pixel TFT's 702; an image signal line parts (hereinafter called signal lines 703); a line buffer 704; a shift pulse switch 708; a horizontal shift register 705; gate signal lines (hereinafter called gate lines) 711; and a vertical shift register 706, and the recording signals are transferred from an input terminal 707 to the successive pixels or successive lines in successive timings.

FIG. 2 is a timing chart showing the driving pulses for said conventional active matrix liquid crystal device, in a line-sequential drive. The image signal $S_{VI}$ to be recorded on the liquid crystal is stored, by an amount corresponding to a line, in the buffer 704, through the shift pulse switch 708 which is controlled by the output signal, of a frequency synchronized with said image signal, from the horizontal shift register 705. After the storage of the image signal of all the pixels of an n-th line is stored in the line buffer 704, the pixel image signals $V_{PEN}$ are recorded in the liquid crystal cells 701 of said line, through an output switch 701, turned on by a signal $\Phi_T$, of the line buffer 704 and pixel switches 702 turned on by signals S2 from the vertical shift register 706. The signal transfer to the liquid crystal cells is conducted collectively for a line, generally during a blanking period in a horizontal scanning period. According to the above-explained timings, the pixel image signals $V_{PEN}$, $V_{PEN+1}$, . . . are recorded in the successive lines.

The signal voltage thus transferred causes the movement of liquid crystal molecules constituting each cell, thereby causing a change in the transmittance of the liquid crystal cell, depending on the directions of polarizing plates so positioned as to constitute a cross polarizer, as shown in FIG. 3.

The signal voltage $V_{SIG}$ shown on the abscissa in FIG. 3 is known to have different meanings according to the liquid crystal to be employed. For example, in case of TN liquid crystal, this value is defined as the effective voltage $V_{rms}$. FIG. 4A provides qualitative explanation on this value. The polarity of the signal voltage is alternated in every frame, in order to avoid the prolonged application of a DC signal to the liquid crystal, but the liquid crystal itself responds to the AC voltage component, represented by hatched areas. Consequently, the effective voltage $V_{rms}$ is represented by the following equation (1)

$$V_{rms} = \sqrt{\frac{1}{t_F}\int_0^{t_F} (V_{LC}(t) - V_{COM})^2\, dt} \tag{1}$$

wherein $t_F$ is the time of two frames and $V_{LC}(t)$ is the signal voltage transferred to the liquid crystal.

On the other hand, the above-mentioned FLC is generally driven with a DC voltage. In the case of a bistable FLC (for example chiral smectic liquid crystal, preferably of a chiral smectic phase C (SmC*) or phase H (SmH*), or of SmI*, SmF* or SmG*), there is employed a driving wave form as shown in FIG. 4B. More specifically, the signal voltage $V_{LC}(t)$ at first resets the liquid crystal to one of the bistable states by $V_R$, and then applies a writing voltage signal $V_W$. The signal voltage $V_{SIG}$ contributing to the transmittance shown in FIG. 3 is again represented by hatched areas. Different from the case of TN liquid crystal, the DC component of the writing voltage constitutes directly the signal voltage $V_{SIG}$.

However, in such conventional configuration, the signal voltage accumulated in the liquid crystal cell, through the signal transfer in the aforementioned timings, is known to fluctuate principally for the following two reasons.

The first reason lies in the swing of the liquid crystal voltage, resulting from a voltage variation in the gate line 711 for driving each pixel switch. The swing $\Delta V_{LC1}$ in the liquid crystal voltage can be represented by the following equation (2)

$$\Delta V_{LC1} = \frac{C_{GD}}{C_{GD} + C_{LC}} \cdot \Delta V_G \tag{2}$$

wherein $C_{LC}$ is the capacitance of the liquid crystal cell, $C_{GD}$ is the gate-drain capacitance of the pixel TFT 702, and $\Delta_{VG}$ is the voltage variation of the gate line 711 (amplitude of gate voltage required for on-off operation of the pixel TFT).

The second reason lies in the swing of the liquid crystal voltage, caused by a voltage variation in the signal line 703 for transferring the image signal $V_{LC}(t)$ to the liquid crystal cells. Said swing $\Delta V_{LC2}$ in the liquid crystal voltage can be represented by the following equation (3):

$$\Delta V_{LC2} = \frac{C_{DS}}{C_{DS} + C_{LC}} \cdot \Delta V_S \quad (3)$$

wherein $C_{LC}$ is the capacitance of the liquid crystal cell, $C_{DS}$ is the parasite capacitance between each pixel electrode and the signal line, and $\Delta V_S$ is the voltage variation in the signal line 703 (namely the image signal voltage for each line or each pixel).

FIG. 5 shows the first-mentioned swing $\Delta V_{LC1}$ of the liquid crystal voltage resulting from the voltage variation in the gate line 711, while FIGS. 6 and 7 show the second-mentioned swing $\Delta V_{LC2}$of the liquid crystal voltage resulting from the voltage variation in the signal line.

As will be apparent from FIG. 5, the voltage swing $\Delta V_{LC1}$ caused by the first reason always varies the voltage applied to the liquid crystal cell to the negative side. Consequently, the voltage change $\Delta V_{LC1}$ generates a state equivalent to the continuous application of a DC voltage component, and the DC voltage component leads to the coagulation of liquid crystal molecules particularly when the TN liquid crystal is employed. Also in the foregoing equation (2), if the capacitance $C_{GD}$ fluctuates for example by the instability in the process, the voltage swing $\Delta V_{LC1}$ itself also fluctuates. In case of display with gradation by a liquid crystal display device, the gradation characteristics are lost if the fluctuation exceeds the voltage range required for the display of one level (ca. 47 mV for a level for displaying 64 levels within an amplitude of 3 V).

Certain proposals have been made for coping with said voltage variation $\Delta V_{CL1}$, particularly for removing the DC voltage component. A widely employed method consists, in case the of using the TN liquid crystal, of providing an auxiliary capacitance in parallel with the capacitance of the liquid crystal, thereby increasing the apparent cell capacitance to increase the denominator in the equation (2), thus reducing the swing. Another proposal consists of providing each pixel with plural TFT's and specially designing the arrangement thereof, thereby rendering the swing less conspicuous. Also for reducing the fluctuation in the swing, attempt has been made to suppress the fluctuation in the parasite capacitance among the elements, by varying the structure of the pixel TFT from the conventional inverse staggered TFT of amorphous silicon to a planar TFT employing polysilicon, and by introducing the ion implantation, utilized in the IC process, into the formation of source and drain of the TFT.

On the other hand, based on the voltage variation $\Delta V_{CL2}$ for the second reason, when a signal voltage is supplied to a pixel and a charge is accumulated in the liquid crystal cell, the signal charge of said pixel varies according to the equation (3) if a signal is transferred to another pixel through the same signal line. In the above-explained circuit configuration, the signal line 703 for signal transfer has a certain parasite capacitance $C_S$ which in practice is several hundred times to several thousand times larger than the liquid crystal capacitance of the pixel. In the transfer of a signal voltage from the buffer to the liquid crystal cell in such system, the signal voltage accumulated in the parasite capacitance is scarcely attenuated, and the voltage of the signal line can be considered to be always fixed at the signal voltage then transferred. When a new signal voltage is subsequently supplied for transfer to another pixel, the voltage of the signal line varies for the same reason. The drawbacks induced by such voltage variation will be considered more closely in the following discussion.

For the purpose of simplicity, it is assumed that, in the entire image frame, a certain horizontal line only displays black (absolute signal level being minimum) while other lines display white (absolute signal level being maximum). In such situation, the signal level of the black-displaying line swings according to the equation (3), at the signal transfers to other lines, and such situation is illustrated in FIGS. 6 and 7. FIG. 6 shows the drawback induced by the voltage variation $\Delta V_{LC2}$ for the second reason, in the case of an FLC, and FIG. 7 shows the drawback in the case of a TN liquid crystal.

FIG. 7 shows a case in which an n-th line in the input image signal $V_{IN}$ displays black while other lines display white. As will be apparent from FIG. 7, the image signal $V_{LCn}$ of the n-th line is subjected to a variation of the signal level by $\Delta V_2$ according to the foregoing equation (3), whereby the effective voltage $V_{rms}$ represented by the equation (1) varies, thus becoming unable to maintain the black level. More specifically, the equation (1) is changed to the following equation (4), whereby the effective voltage $V_{rms}$ varies:

$$V_{rms} = \sqrt{\frac{1}{t_F}\int^{t_F} (V_{LC}(t) - \Delta V_{LC2} - V_{COM})^2\, dt} \quad (4)$$

FIG. 6 shows that, in case of FLC, the voltage $V_{LCn}$ written in a pixel in the n-th line varies by the subsequent write-in of the pixel image signals by gate signals $S2_{n+1}$, $S2_{n+2}$, $S2_{n+3}$, . . . of another line. Consequently the display level of said line gradually varies to another level by the voltage variation $\Delta V_{LC2}$ according to the equation (3), thus becoming unable to maintain the original display level.

This phenomenon can be numerically analyzed in the following manner.

As an example, there are employed a signal line 703 of A1 (aluminum) with a width of 3 μm and a thickness of 0.5 μm; a pixel electrode of a size of 30×30 μm or 150×150 μm; a liquid crystal cell gap of 6 μm; a dielectric constant of liquid crystal of 5.0; an interlayer insulation film between the signal line and the gate line with a dielectric constant of 3.9 and a thickness of 0.5 μm; a distance between the signal line and the pixel electrode of 3 μm; and a driving voltage of ±5.0 V at maximum for the liquid crystal. In such system, by calculating the parasitic capacitance $V_{DS}$ and the liquid crystal cell capacitance $C_{LC}$ and substituting these values into the equation (3), there is obtained a variation in the pixel voltage as represented by the following equation (5), for a pixel size of 150×150 μm:

$$\Delta V_{LC2} = \frac{C_{DS} \times V_S}{C_{DS} + C_{LC}} = \frac{1.37E{-}14 \times 10}{1.37E{-}14 + 1.66E{-}13} = 0.76\ [V] \quad (5)$$

In the case of effective voltage drive as in the TN liquid crystal, the effective voltage $V_{rms}$ varies according to the foregoing equation (4), and, in the case of DC voltage drive as in the FLC, said voltage variation is directly reflected in the variation of the signal voltage for the liquid crystal.

Such voltage variation is more complex in case the signal level varies linearly as in the ordinary television image signal. In any case, the signal level of a pixel varies at the signal transfer to another pixel, if the level of said signal is different from that of the first-mentioned pixel. As said variation occurs in a direction to approach the signal level of said another pixel, the image appears to blot between the pixels or between the lines, and the image boundary becomes less clear. Such blotting appears as vertically streaking smears on the image, thus significantly deteriorating the image quality.

Also for a pixel size of 30×30 μm, there is obtained the result shown by the equation (6) in the above-mentioned black-and-white display. It will thus be understood that the voltage variation $\Delta V_{LC2}$ of the second reason becomes nonnegligibly large, as the pixel size becomes smaller and the resolving power of the display device becomes higher:

$$\Delta V_{LC2} = \frac{C_{DS} \times V_S}{C_{DS} + C_{LC}} = \frac{2.75E-15 \times 5}{2.75E-15 + 6.64E-15} = 1.47\ [V] \quad (6)$$

This is because the decrease in the parasitic capacitance $C_{DS}$ between the signal line and each pixel electrode at the reduction of pixel size is less than that in the liquid crystal capacitance $C_{LC}$, so that the influence of $C_{DS}$ becomes more conspicuous by the reduction in the liquid crystal capacitance $C_{LC}$.

In order to cancel the voltage variation $\Delta V_{LC2}$ of the second reason, there is conceived to reduce $C_{DS}$ to zero, but this is absolutely impossible as long as the above-explained circuit configuration is adopted, regardless of how finely it is made. Nextly conceivable is the reduction of the voltage variation in the signal line, and, for this purpose, it is necessary to reduce the proportion of the parasite capacitance of the signal line with respect to the entire capacitance. However, the parasite capacitance of the signal line, though being reducible to a certain extent by the reduction of the width of the line, will still be far larger (still several hundred times to several thousand times) than the capacitances $C_{DS}$, $C_{LC}$) at the liquid crystal side. Also the capacitance $C_{DS}$ cannot be made larger, as it is mostly determined by the structure and size of the pixel part.

Consequently, there is nextly conceived as the increase of the liquid crystal capacitance $C_{LC}$. For this purpose it is conceivable to form, as in the current TN liquid crystal cell configuration, to form a large auxiliary capacitance, parallel to the liquid crystal capacitance $C_{LC}$. However, in order to cancel the influence of the capacitance $C_S$ of several hundred times to several thousand times, it is required to attach an auxiliary capacitance of a similar or larger magnitude, and the addition of such large auxiliary capacitance increases the load of signal transfer to the pixel parts. Such capacitance cannot be increased excessively since the increase in the number of pixels reduces the time allotted to each line.

In summary, the drawbacks associated with the voltage variation $\Delta V_{LC2}$ of the second reason will become more conspicuous in the display devices requiring high definition and high-speed drive, such as the display for the high definition television which is expected to become rapidly popular in the future.

On the other hand, the status of the display device employing liquid crystal with memory property is as follows. In such case, the optical axis of liquid crystal and that of the polarizing plates are so aligned that one of two optical bistable states provides black display while the other provides black display. A voltage providing the white display is called an optical information recording signal, while a voltage providing the black display is called a reset signal. In the case of driving the FLC with bistable states, each pixel has to be given, prior to the access to the recording signal, a black (reset) signal in order to reset the record at the preceding access.

In practice, however, the parasitic capacitance $C_S$ is several hundred times to several thousand times larger than the liquid crystal capacitance in the pixel part, and is about equal to or even larger than the capacitance in the buffer. Thus the signal voltage (optical information recording signal or reset signal) entered from the input terminal 707 is transferred while charging and discharging the capacitance of the buffer and the parasitic capacitance of the line, whereby the signal transferring ability of the device is deteriorated, also under influence of the resistance in the lines. Besides, these phenomena become more conspicuous as the display becomes larger in size and higher in definition.

Furthermore, the conventional driving method has been associated with the following drawbacks.

In the driving method shown in FIG. 7, the voltage of the pixel electrode, though variable depending on the signal voltage, is always positive with respect to the potential of the common electrode, and such situation is equivalent to the continuous application of a DC voltage component to the liquid crystal cell. Such DC component leads to the coagulation of the liquid crystal molecules, particularly in case of the TN liquid crystal.

Certain proposals have been made for eliminating said DC voltage component. Already employed widely is the frame inversion driving method shown in FIG. 4A. In this driving method, the polarity of the signal voltage with respect to the common electrode potential $V_{COM}$ is inverted every frame in such a manner that an N-th signal voltage is applied positively with respect to the potential of the common electrode while an (N+1)-th signal voltage is applied negatively, whereby the DC voltage component applied to the liquid crystal cell is cancelled and the coagulation of the liquid crystal molecules is prevented.

There have also been proposed driving methods with inversion in every horizontal scanning period or in every pixel, for attaining similar effects. However, such methods are still associated with the following drawbacks.

With a signal voltage $V_N$ applied to the pixel electrode at the N-th time and a signal voltage $-V_{N+1}$ applied at the (N+1)-th time, a bias $(V_N+V_{N+1})$ is applied between the source and the drain of the pixel TFT 102 at the signal application of the (N+1)-th time. Thus, in the above-explained inversion driving method with a maximum amplitude $V_{MAX}$ of the signal voltage, there is applied a bias of $2_{MAX}$ at maximum between the source and the drain of the pixel TFT 102, which is therefore required to have an on-state source-drain voltage resistance exceeding said maximum bias.

Such requirement can be alleviated by a reduction in the maximum amplitude of the signal voltage, but such method is undesirable because it tends to sacrifice the display of gradation as will be understood from FIG. 3, whereas the display devices require an improved definition in the future, as in those for the high definition television which is expected to become rapidly popular.

Another method for alleviating said voltage resistance requirement lies in the use of a MOS transistor of a high voltage resistance structure, such as the LDD (lightly doped drain) structure, as the pixel switch 102. However, the MOS transistor of currently proposed structure for high voltage resistance is associated with a drawback of a loss in gm because of an increased serial resistance to the source and the drain, as a trade-off for the improvement in the voltage resistance. As explained above, high-speed drive will be increasingly required for the liquid crystal devices, as in those for high-definition television, and a larger gm will be required for this purpose in the pixel switching TFT. Besides, the MOS transistor of the above-mentioned high voltage resistance structure is inevitably associated with a high manufacturing cost, because of the complex manufacturing process.

Such drawbacks are not limited to the case of TN liquid crystal, but also are present in case of driving FLC by active matrix elements, utilizing a signal as shown in FIG. 4B.

SUMMARY OF THE INVENTION

An object of the present invention is to provide a liquid crystal device of a high definition, capable of driving a unit liquid crystal cell with a high speed, and a driving method therefor.

Another object of the present invention is to provide a liquid crystal device capable of preventing the undesirable influence of the parasitic capacitance on the resetting operation, and a driving method therefor.

Still another object of the present invention is to provide a liquid crystal device enabling drive of a higher speed than in the conventional configuration, even with the use of an active element of a simple structure as the pixel switch, and a driving method therefor.

Still another object of the present invention is to provide a liquid crystal device capable of variation in the information signal voltage applied to the unit cell, and a driving method therefor.

The above-mentioned objects can be attained, according to the present invention, by a liquid crystal device of active matrix type provided with a layer of a liquid crystal material and a plurality of unit cells each including an active element, comprising a circuit for maintaining a signal line, for supplying signals for determining the optical state of the liquid crystal material, at a reference potential in a period, excluding a period in which said signals are supplied to said unit cells.

Also the above-mentioned objects can be attained, according to the present invention, by a liquid crystal device of active matrix type provided with a layer of a liquid crystal material and a plurality of unit cells each including an active element, comprising a circuit which supplies said unit cells with time-sequential signals for determining the optical state of the liquid crystal and which maintains said unit cells at a reference potential after the supply of a first signal to said unit cells but prior to the supply thereto of a second signal following the first signal.

Also the above-mentioned objects can be attained, according to the present invention, by a liquid crystal device of active matrix type provided with a layer of a liquid crystal material having at least two stable states, and a plurality of unit cells each including an active element, comprising:

a circuit for supplying said unit cells with time-sequential signals for determining the optical state of the liquid crystal material through a common signal line;

a circuit for maintaining said unit cells at a reference potential after the supply of a first signal of said time-sequential signals to said unit cells but prior to the supply thereto of a second signal succeeding to said first signal;

wherein a reference voltage supplying line, for supplying the reference voltage for maintaining said unit cells at the reference potential, is provided separately from said common signal line.

Also the above-mentioned objects can be attained, according to the present invention, by a driving method for a liquid crystal device of active matrix type provided with a layer of a liquid crystal material and a plurality of unit cells each including an active element, comprising a step of maintaining a signal line, for supplying signals for determining the optical state of the liquid crystal material, at a reference potential in a period excluding a period in which said signals are supplied to said unit cells.

Also the above-mentioned objects can be attained, according to the present invention, by a driving method for a liquid crystal device of active matrix type, provided with a layer of a liquid crystal material and a plurality of unit cells each including an active element, comprising a step of maintaining said unit cells at a reference potential after the supply of a first signal, in time-sequential signals for determining the optical state of the liquid crystal material, to said unit cells but prior to the supply thereto of a second signal succeeding to said first signal in said time-sequential signals.

Also the above-mentioned objects can be attained, according to the present invention, by a driving method for a liquid crystal device of active matrix type, provided with a layer of a liquid crystal material having at least two stable states, and a plurality of unit cells each including an active element, comprising steps of:

supplying time-sequential signals, for determining the optical state of the liquid crystal material, from a common signal line to said units cells; and connecting said units cells to a reference voltage supply line which is separate from said common signal line, thereby maintaining said unit cells at a reference potential, after the supply of a first signal in said time-sequential signals to said unit cells but prior to the supply thereto of a second signal succeeding to said first signal.

DETAILED DESCRIPTION OF THE PREFERRED EMBODIMENTS

The liquid crystal material employed in the present invention may have a stable state, or at least two stable states. The former is represented by nematic liquid crystals, such as twisted nematic liquid crystal or super twisted nematic liquid crystal. The latter is represented by ferroelectric liquid crystals, preferably chiral smectic liquid crystals. Specific examples of such liquid crystal includes those of chiral smectic phase C (SmC*), SmH*, SmI*, SmF* and SmG*.

Also the means for supplying the reference voltage, for maintaining the unit cells or the signal lines at the reference potential can be a bus line (power supply line) for supplying said voltage from an external power source, or a reference voltage source provided in an integrated semiconductor circuit for generating the reference voltage by dropping a voltage supplied from an external power source and a line connected thereto.

[Embodiment 1]

Figure 8:
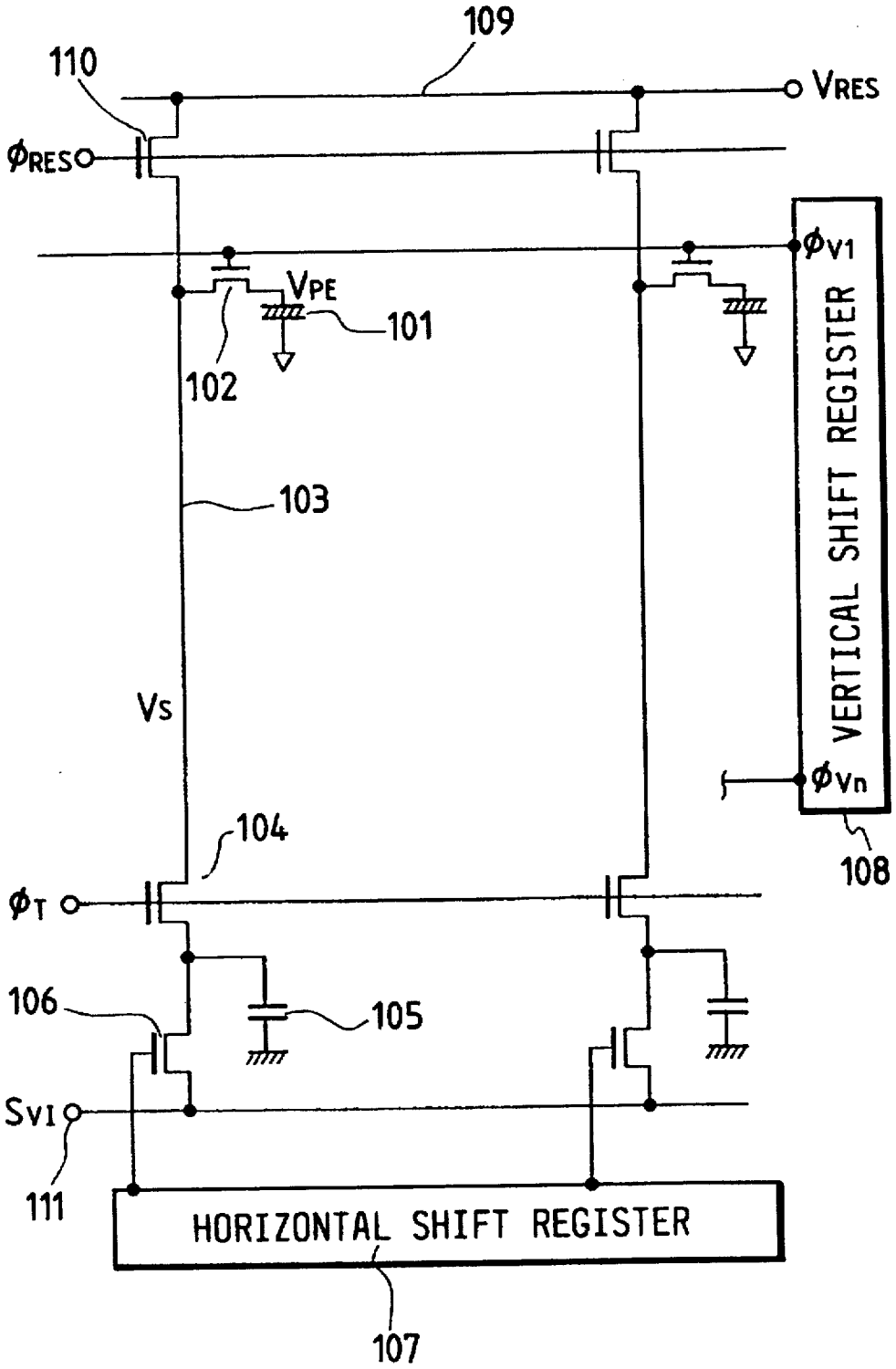
FIG. 8 is a circuit diagram of a liquid crystal display device constituting embodiments 1, 2 and 4 of the present invention.

FIG. 8 is a diagram of a driving circuit of an active matrix liquid crystal device constituting an embodiment of the present invention.

There are shown a capacitance 101 corresponding to a liquid crystal cell; a pixel TFT 102 serving as a selector switch for applying a signal voltage to the liquid crystal cell 101; a signal line 103; a transfer gate 104; a buffer capacitance 105; a switching TFT 106 for accumulating an external signal pulse in the corresponding buffer capacitance 105; a horizontal shift register 107 for releasing, in succession, selection signals for pulse driving of the switching TFT's 106; and a vertical shift register 108 for releasing, in succession, selection signals for driving the pixel TFT's 102.

The driving circuit is further provided with a holding signal line 109 connected to a bias source for fixing the voltage of the signal lines and serving to maintain the signal lines 103 at a constant voltage; and switching TFT's 110 for selectively connecting the recording signal lines 103 with the holding signal line 109.

In the following there will be explained the functions of this circuit in case of line-sequential drive of an active matrix device employing the TN liquid crystal.

In the above-explained circuit configuration, when the image signals $S_{VI}$ of a line are entered in succession from an input terminal 111, the horizontal shift register 107 driven by the pulses synchronized with the frequency of the image signals turns on the switching TFT's 106 in succession, whereby the image signals of the pixels of said line are transferred in succession to the buffer capacitances 105. Then, in so-called blanking period which is after the signal transfer to the buffer capacitance 105 of the last bit in said line but prior to the entry of the image signals of a next line into the input terminal 111, the transfer gates 104 and the pixel TFT's 102 are simultaneously turned on whereby the image signals are transferred to the liquid crystal cells 101 of the pixels of the line. In fact the signal transfer to the pixels is executed within a part of the blanking period, and the remaining part is used for an operation for maintaining the signal line 103 at a constant voltage.

The operation is achieved by turning on the switching TFT's 110, after the transfer gates 104 and the pixel TFT's 102 are turned off. The switching TFT's 110 are turned on for a period enough for charging the parasitic capacitances associated with the signal lines 103, and are turned off prior to the end of the blanking period. As a result, the signal lines 103 are maintained at a voltage determined by the holding signal line 109, until the next transfer of image signals, namely until the start of the blanking period of the next horizontal scanning period.

For example, in the image signals for the high-definition television, the horizontal scanning period is about 29 μsec., including a blanking period of about 3 μsec. Consequently the turn-on period of the transfer gates 104 and the pixel TFT's 102 for the transfer of the image signals to the pixels and that of the switching TFT's 110 for maintaining the signal lines 103 at the constant voltage will be about 1 μsec. each. Therefore, the signal line 103 is set at the voltage of the image signal for a period of 1/29 of the horizontal scanning period, but is maintained at the constant voltage for the remaining part, namely 28/29 of the horizontal scanning period. By repeating such operation, the voltage $V_S$ of the signal line 103 is maintained at a constant value for most of the entire display period, despite of the variation in the image signal voltage.

Figure 9:
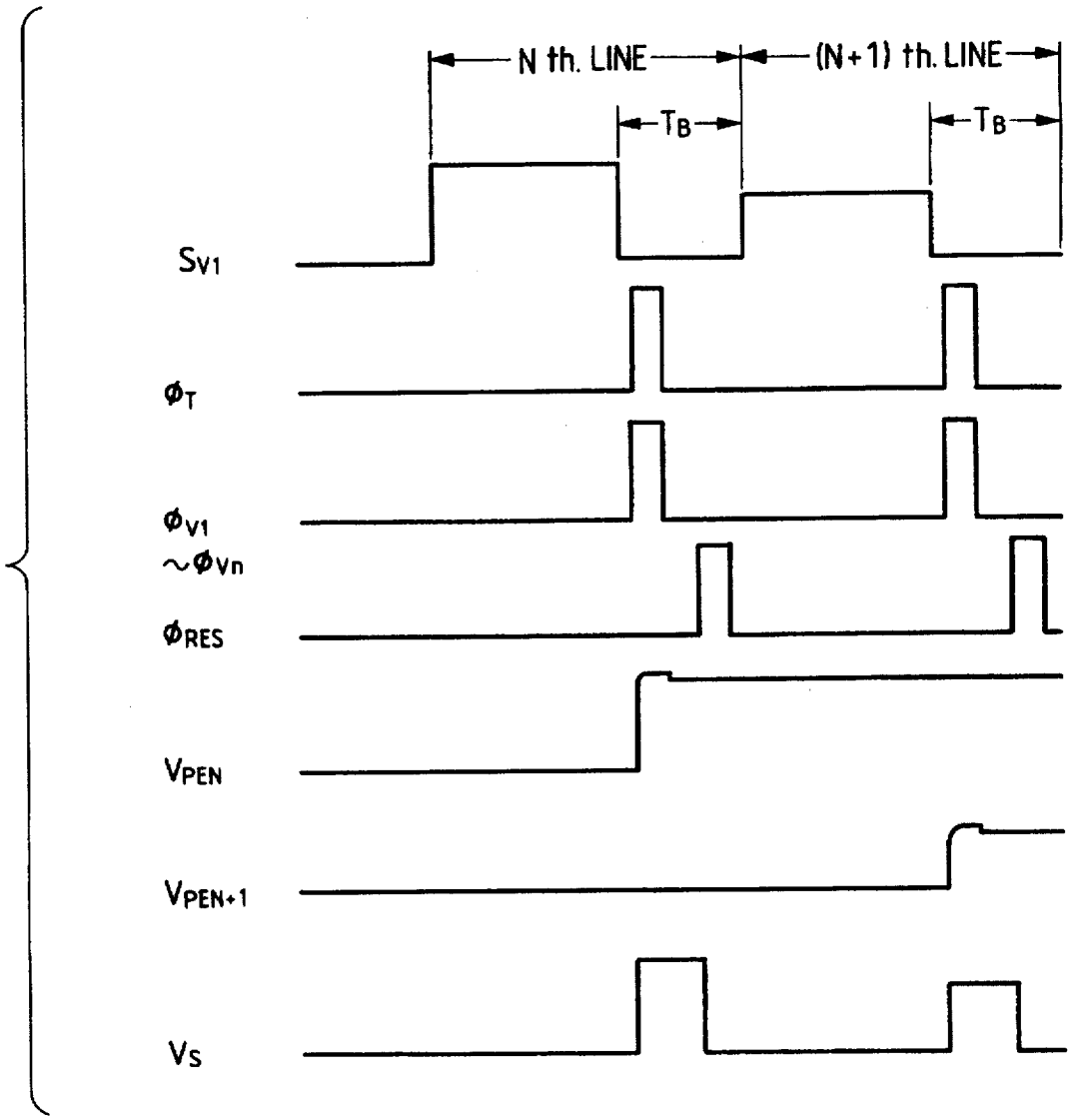
FIG. 9 is a timing chart for explaining the driving method for the liquid crystal display device of the embodiment 1.

FIG. 9 shows the timings of the above-explained operations. In FIG. 9 there are shown the image signals $S_{VI}$ for the N-th and (N+1)-th lines; gate input signals $\phi_T$ and $\phi_{V1}$ –$\phi_{Vn}$ respectively of the transfer gates 104 and the pixel TFT's 102; a gate input signal S3 for the switching TFT's 110; signal voltages $V_{PEN}$, $V_{PEN+1}$ respectively of the pixels of the N-th and (N+1)-th lines; and the voltage $V_S$ of the signal lines 103. As will be apparent from this chart, the voltage $V_S$ of the signal lines is always maintained at a constant value $V_{RES}$, only except for a part of the blanking period $T_B$.

With the above-explained timings, the potential $V_S$ of the signal lines 103 only varies for a period of about 1 μsec. at longest, and the liquid crystal molecules do not respond to such voltage variation within such short period. Consequently, the voltage of the signal lines 103 which has to be taken into consideration for the liquid crystal molecules is the constant voltage $V_{RES}$ supplied constantly by the holding signal line 109. When the voltage variation $\Delta V_S$ in the signal lines 103 becomes constant, the voltage variation $\Delta V_{CL2}$ in the liquid crystal capacitance 101 where the pixel TFT 102 is turned off is always constant, according to the foregoing equation (3). The effective voltage $V_{rms}$ actually applied to the liquid crystal in such state is represented by the following equation (7):

$$V_{rms}=\sqrt{\frac{1}{t_F}\int_0^{t_F}(V_{LC}(t)-\Delta V_{LC2}-V_{COM})^2\,dt} \quad (7)$$

In contrast to the conventional configuration in which, even for a given $V_{LC}$, the effective voltage $V_{rms}$ always varies depending on the values of other pixel signals, the effective voltage $V_{rms}$ in the present embodiment is always uniquely determined by the given signal voltage $V_{LC}$. Consequently the curve showing the relation between the transmittance and the effective voltage $V_{rms}$ is aberrated by the contribution of $\Delta V_{CL2}$, but a one-to-one correspondence is established therebetween. Thus the characteristics of the display device may be determined from thus aberrated curve. Otherwise, a display device of the originally designed characteristics without said aberration may also be obtained by regulating the signal voltage $V_{LC}$, as will be apparent from the equation (7).

It is therefore rendered possible to avoid the vertically streaking smears, resulting from the swing of the signal voltage in each pixel, induced by the signals to other pixels connected to a same signal line 103, whereby the image quality is improved.

As an example, in the signal timings of the above-explained example, by setting the original signal voltage in a liquid crystal capacitance 101 as 0 V and setting the holding voltage $V_{RES}$ of the signal line 103 as 0 V, said liquid crystal capacitance is maintained at 0 V until the application of a next signal voltage of another value.

Also in said example, by selecting the holding voltage at a value not equal to the signal voltage (=0 V) of the considered liquid crystal capacity 101, for example at the center value (=2.5 V) of the maximum (=5 V) and minimum (=0 V) of the signal voltage, the variation $\Delta V_{LC2}$ in the signal voltage of the liquid crystal capacitance 101 for a cell of a size of 150 μ is given by the following equation (8):

$$\Delta V_{LC2}=\frac{C_{DS}\times V_S}{C_{DS}+C_{LC}}=\frac{1.37E-14\times 2.5}{1.37E-14+1.66E-13}=0.19\ [V] \quad (8)$$

Also in case the holding voltage is selected at the maximum value (=5 V) of the signal voltage, there is obtained a value represented by the following equation (9):

$$\Delta V_{LC2}=\frac{C_{DS}\times V_S}{C_{DS}+C_{LC}}=\frac{1.37E-14\times 5}{1.37E-14+1.66E-13}=0.38\ [V] \quad (9)$$

Consequently the display device can be designed in advance, in consideration of these variations $\Delta V_{LC2}$ in the signal voltage. Otherwise, since said variation $\Delta V_{LC2}$ is constant, regardless of the signal voltages in other pixels, the original signal voltage may be altered so as to cancel said variation $\Delta V_{LC2}$. For example, in order to obtain a pixel signal voltage of 0 V when the holding voltage is selected as 2.5 V, the original signal voltage should be selected as −0.20 V. Also in order to obtain a pixel signal voltage of 0 V when the holding voltage is selected as 5 V, the original signal voltage should be selected as −0.4 V. Stated differently, the original voltage $V_{LC}$should be selected in such a manner that the effective voltage. $V_{rms}$ in the equation (1) becomes equal to that in the equation (4).

As will be apparent from the foregoing discussion, the signal voltage of each pixel is no longer influenced by that of other pixels by mere setting that $\Delta V_{LC2}$ becomes constant, and the performances of the display device can therefore be improved. Particularly the vertically streaking smear is almost completely eliminated.

As an example, in a display of the NTSC image signal on a liquid crystal panel employing the driving circuit of the present embodiment and containing 360×480 pixels (×3, for R, G, B) with a holding voltage of 0 V, the blotting phenomenon of pixels in the vertical direction was not observed at all. In this display, there was employed the frame inversion drive in which the polarity of the signal voltage was inverted every frame, with a driving voltage of ±5–0 V, and the input image signal was corrected in advance according to the foregoing equation (7).

Also in a similar drive with a driving voltage of ±8–0 V and without the correction according to the equation (7), no significant difference from the above-mentioned case could be observed, except for an increased amplitude of the driving voltage.

Furthermore, similar effects could be obtained in cases with a driving voltage of ±5–0 V, a holding voltage $V_{RES}$ of 2.5 V or 5 V and with the correction according to the equation (7).

[Embodiment 2]

Figure 10:
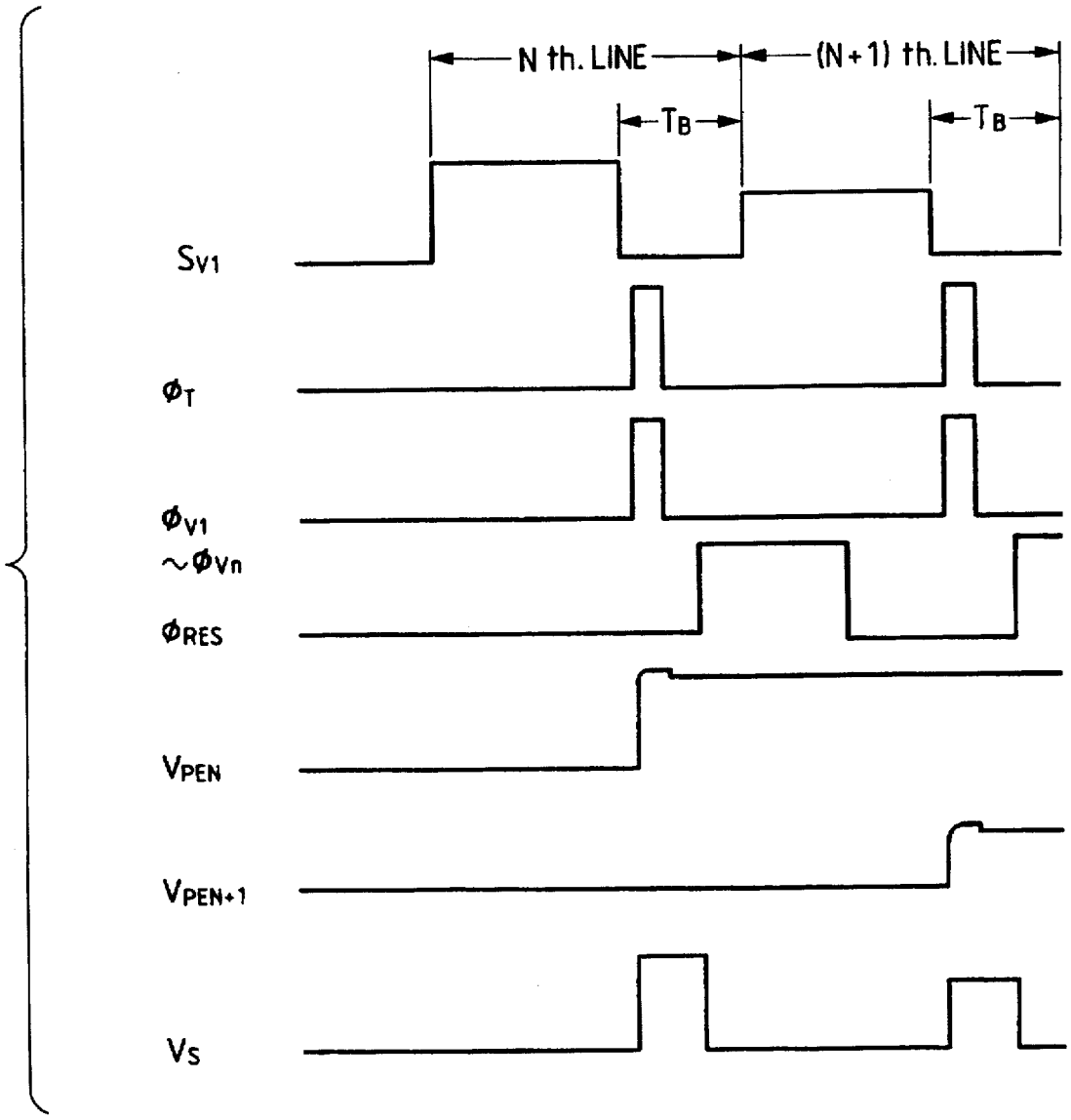
FIG. 10 is a timing chart for explaining the driving method for the liquid crystal display device of the embodiment 1.

FIG. 10 shows the timing of functions in a driving circuit constituting an embodiment 2 of the present invention. The configuration of the driving circuit is same as that in the embodiment 1, and the transfer of the image signals to the pixels is executed utilizing a part of the blanking period as explained before. However, the difference from the embodiment 1 lies in a fact that the operation of maintaining the signal lines 103 at a constant value is executed not only in the blanking period but also in a horizontal scanning period. More specifically, after the transfer gates 104 and the pixel TFT's 102 are turned off, the switching TFT's 110 are turned on, and then turned off at least after a time enough for charging the parasitic capacitances associated with the signal lines 103 but prior to the transfer of the signals of a next line to the pixels.

When a liquid crystal panel, same as in the embodiment 1, was driven with the above-explained method, under similar conditions with a driving voltage of ±5–0 V, a holding voltage of 0 V and with correction for the input signal, there could be attained similar effects.

[Embodiment 3]

Figure 11:
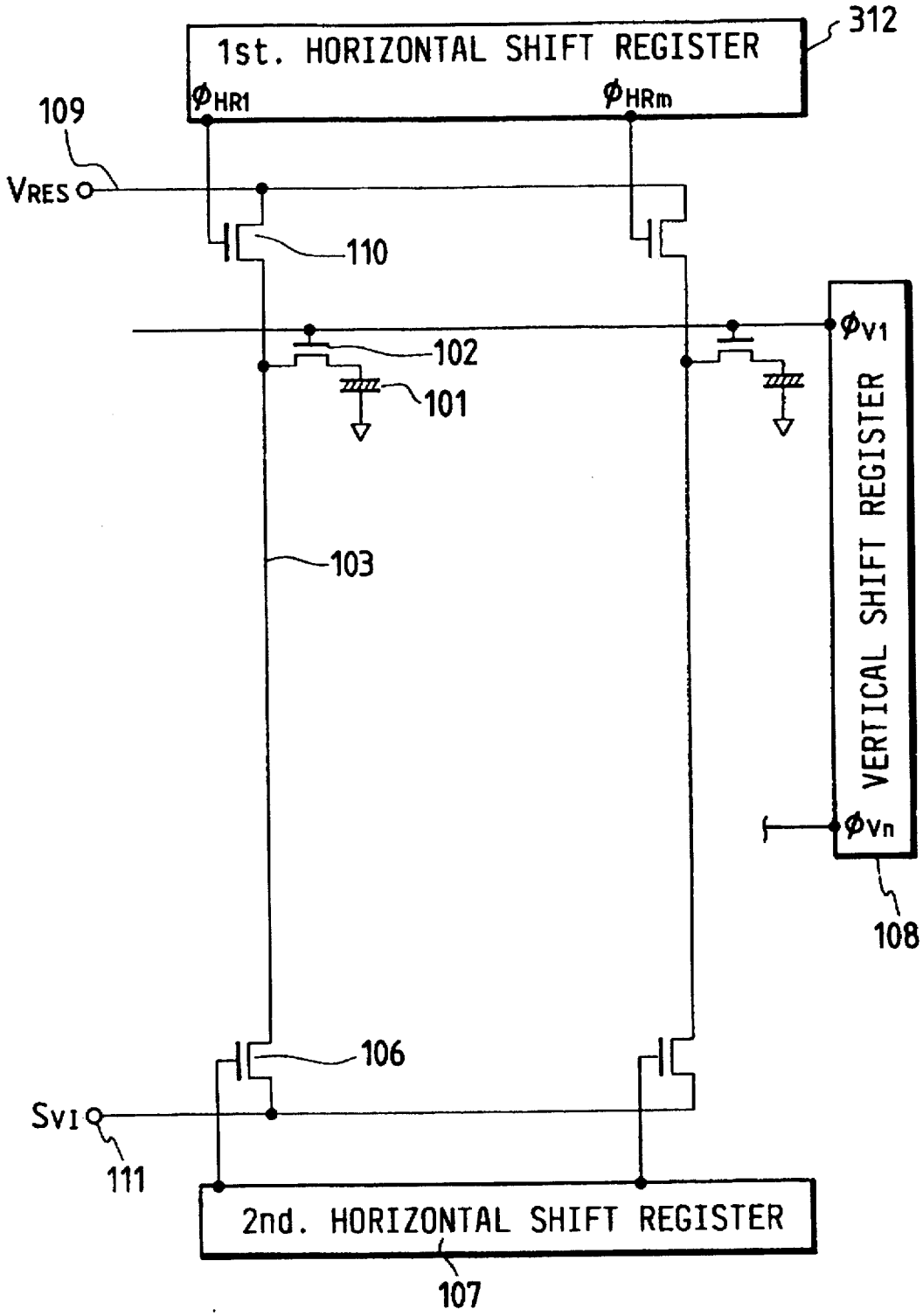
FIG. 11 is a circuit diagram of a liquid crystal display device constituting an embodiment 3 of the present invention.

FIG. 11 shows a driving circuit for a sequential-drive active matrix crystal device, constituting an embodiment 3 of the present invention. In contrast to the line-sequential drive for every horizontal line employed in the embodiment 1, the present embodiment employs a pixel-sequential drive.

In this driving circuit, the signal voltages are directly supplied, in succession, to the liquid crystal cells 101, without employing the transfer gates 104 and the buffer capacitances 105 shown in FIG. 8, and a second horizontal shift register 312 is provided for driving the switching TFT's 110 in succession, according to the timings of said supply.

In the above-explained circuit configuration, when the image signals $S_{VI}$ of a line are entered in succession from the input terminal 111, the image signals of the pixels of said line are transferred, in succession, to all the pixels of said horizontal line, through switching TFT's 106 which are turned on by the first horizontal shift register driven by the pulses synchronized with the frequency of said image signals, and through the pixel TFT's turned on by the vertical shift register 108. The TFT's 106, 102 which have been turned on for the signal transfer are turned off after said signal transfer, and the switching TFT's 110 are instead turned on by the second shift register 312, whereby all the vertical signal lines 103 are maintained at a constant holding voltage. For example, in case of NTSC television image signal, a horizontal scanning period is about 63 μsec., and, if a horizontal scanning line contains 480 pixels, the signal pulse width per pixel is about 100 nsec. Consequently the signal line 103 is maintained at the image signal voltage for a period of 1/630 of the horizontal scanning period, but is maintained for the remaining period of 629/630 at the constant voltage. By the repetition of such operation, the voltage of the signal line 103 is maintained at a constant voltage for most of the entire display period, despite the variation in the image signal voltage.

Figure 12:
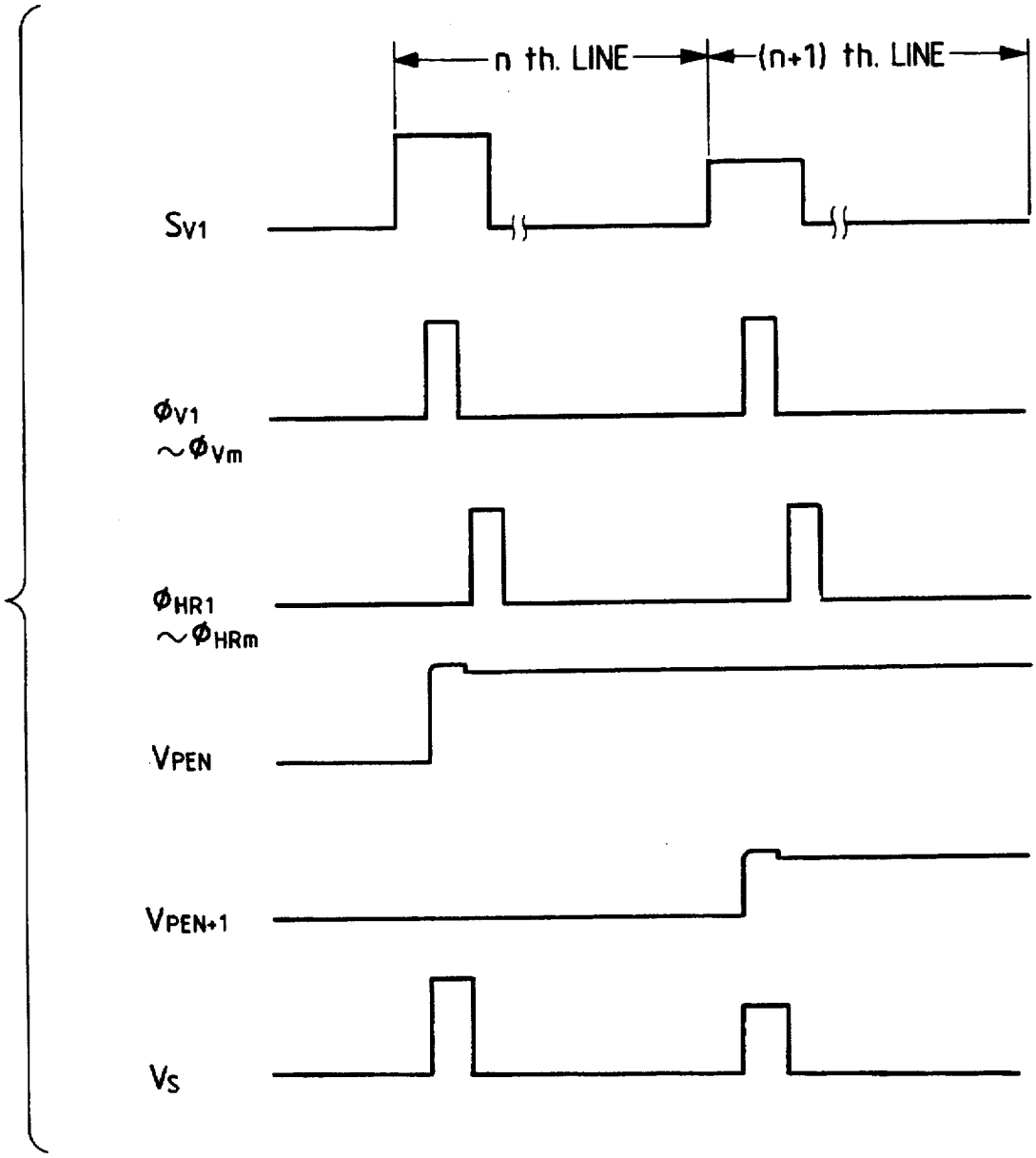
FIG. 12 is a timing chart for explaining the driving method for the liquid crystal display device of the embodiment 3.

FIG. 12 shows the timings of the above-explained operations. In FIG. 12 there are shown the image signals $S_{VI}$ for the N-th and (N+1)-th lines; gate input signals $\phi_{V1}-\phi_{Vn}$ for the pixel TFT's 102; gate input signals $\phi_{HR1}-\phi_{HRm}$ of the switching TFT's 110; signal voltages $V_{PEN}$, $V_{PIN+1}$ respectively for the pixels of the N-th and (N+1)-th lines; and voltage $V_S$ of the signal lines 103. As will be apparent from this chart, the voltage $V_S$ of the signal lines is always maintained at a constant value, only except for a part of the horizontal scanning period.

For reasons similar to those explained in the embodiment 1, the signal voltage of each pixel is no longer influenced by those of other pixels, and there can be attained improvements in the performances of the display device, particularly the prevention of vertically streaking smear.

When a liquid crystal panel, similar to that in the embodiment 1, was driven with the driving circuit and method of the present embodiment, under similar conditions with a driving voltage of ±5–0 V, a holding voltage of 0 V and with correction for the input signals, there could be attained similar effects.

[Embodiment 4]

In the foregoing embodiments 1 to 3, the TFT's 110 of the pixels are turned off when the signal lines are maintained at the constant voltage. In contrast, the present embodiment provides a driving method of maintaining the signal lines 103 at the constant voltage while the TFT's of the pixels are turned on. For example, in case of using a liquid crystal material with memory property such as the FLC explained before, it is necessary to reset the preceding signal, governing the optical state, prior to the writing of a new signal voltage. Said liquid crystal resetting signal is normally selected at a same signal level for all the pixels. Consequently, the voltage of said liquid crystal resetting signal may also be utilized as the holding voltage for the signal lines.

This driving method can also be executed in the driving circuit shown in FIG. 8, and is different from the methods in the embodiments 1 to 3, in that the TFT's 102 (signals $\phi_{V1}-\phi_{Vn}$) of the pixels are turned on twice at the transfer of the image signals and at the transfer of the holding voltage (resetting signal).

Figure 13:
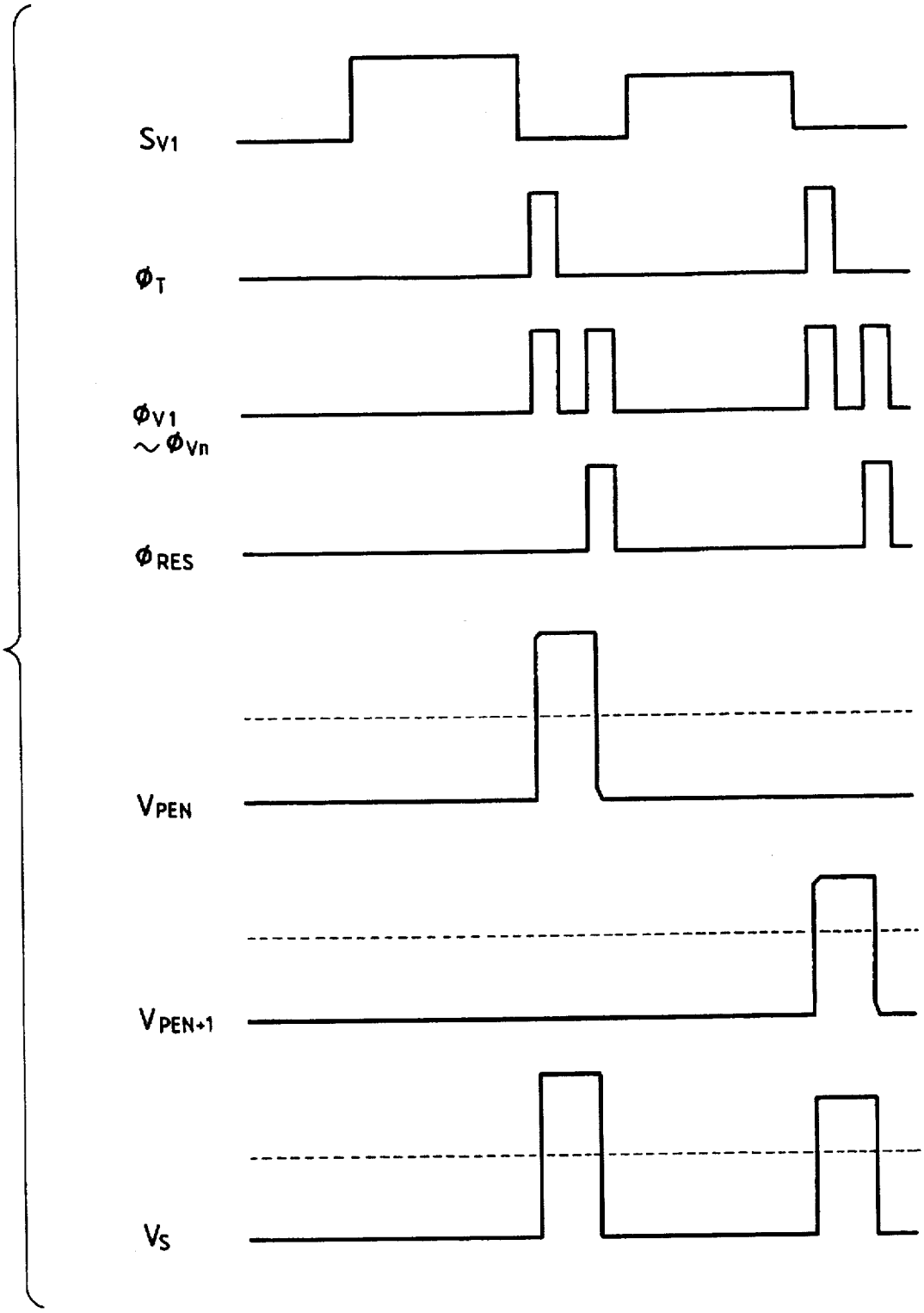
FIG. 13 is a timing chart for explaining the driving method for the liquid crystal display device of the embodiment 4.

FIG. 13 shows the timings of operations of the present embodiment. As will be apparent from this chart, the voltage $V_S$ of the signal lines are always maintained at a constant voltage, except for a part of the blanking period.

As an example, in a display of the NTSC image signal on a liquid crystal panel employing the driving circuit shown in FIG. 8 and containing 360×480 pixels (×3, for R, G and B) with a holding voltage (liquid crystal cell resetting voltage) of −7 V, the blotting phenomenon of pixels in the vertical direction was not observed at all. In said display there were employed driving voltages of +7–0 V for image display and −7 V for resetting. The image input signals were corrected in advance, according to the foregoing equation (7).

The access timing, for providing the holding signal immediately before the recording of optical information in each pixel or line, is not limited to those in the foregoing embodiments, but can be suitably selected according to the response of the liquid crystal material to be employed. For example, if the response of the liquid crystal to be employed is slow, the holding signal may be applied to a line in advance by several line scanning periods before the recording of optical information signals in said line, thereby providing an ample response time.

Also the number of pixels or the format of the image signals are not limited to those in the foregoing embodiments, and the present invention is naturally effective in the display devices designed, for example, for the high definition television or the like.

More precisely, even in the present invention, the swing of the signal voltage by the aforementioned second reason appears solely during the period of transfer of the signal voltages to the pixels. Such signal voltage swing in the signal transfer period should also be taken into consideration in case gradation is required in the display device, since such gradation characteristics are destructed if the influence, on the effective voltage, of the sum of said swing in the signal transfer period exceeds one level of said gradation in one frame period. As already explained above, the effective voltage $V_{rms}$ contributing to the drive of TN liquid crystal is represented by the following equation (10):

$$V_{rms}=\sqrt{\frac{1}{t_F}\int_0^{t_F}(V_{LC}(t)-V_{COM})^2\,dt} \tag{10}$$

By extending the above-explained concept to a case with a number N of scanning lines, n levels of gradation in the display, a maximum value $V_{rms\cdot MAX}$ and a minimum value $V_{rms\cdot MIN}$ of the effective voltage required for the display with gradation, a signal transfer period $t_s$, a swing $\Delta V_{LC2}(t)$ in each signal transfer period, and a horizontal scanning period $t_H$, the signal transfer period $t_s$ has to satisfy the following equation (11):

$$\frac{(N-1)\sqrt{\frac{1}{t_S}\int_0^{t_S}(\Delta V_{LC2}(t)-V_{COM})^2\,dt}}{V_{rms\cdot MAX}-V_{rms\cdot MIN}}\leq\frac{1}{n} \tag{11}$$

By solving the equation (11), the minimum duty ratio of the horizontal scanning period $t_H$ and the signal transfer period $t_S$ can be determined. The minimum duty ratio should always be taken into consideration even in the exploitation of the present invention.

As an example, there can be considered a system employing signal lines 103 of Al (aluminum) with a width of 3 μm and a thickness of 0.5 μm; pixel electrodes of a size of 30×30 μm or 150×150 μm; a cell gap of 6 μm; a dielectric constant of liquid crystal of 5.0; an interlayer insulation film between the signal line and the gate line with a dielectric constant of 3.9 and a thickness of 0.5 μm; a distance of 3 μm between the signal line and the pixel electrode; a maximum liquid crystal driving voltage of ±5.0 V; and a holding voltage of 0 V. In case of display with 256 levels in such device, said minimum duty ratio is about 75.1 for the liquid crystal cells of 30×30 μm and about 38.8 for the liquid crystal cells of 150×150 μm.

In the above-explained embodiments 1 to 4, the signal lines are maintained at a constant voltage for the almost entire period, only excluding the period of supply of the recording signal voltages to the pixels. Thus the recording signal voltage supplied to each pixel is no longer influenced by those supplied to other pixels, whereby the vertically streaking smear can be prevented and there is attained a driving method suitable for display devices requiring high definition and high-speed drive, such as those for the high definition television. Thus provided is an active matrix liquid crystal display device capable of high-speed drive, which can be utilized for a flat display for direct observation or a projection display, with a high definition. It is also possible to obtain a flat color television or a projection television of a high definition, in reflective or transmissive type, by providing the respective pixels with color filters or by employing a plurality of the liquid crystal devices employing the driving method or driving circuitry of the present invention and illuminating said devices with colored lights.

[Embodiment 5]

In the following there will be a detailed explanation of embodiment 5 of the present invention, with reference to the attached drawings.

Figure 14:
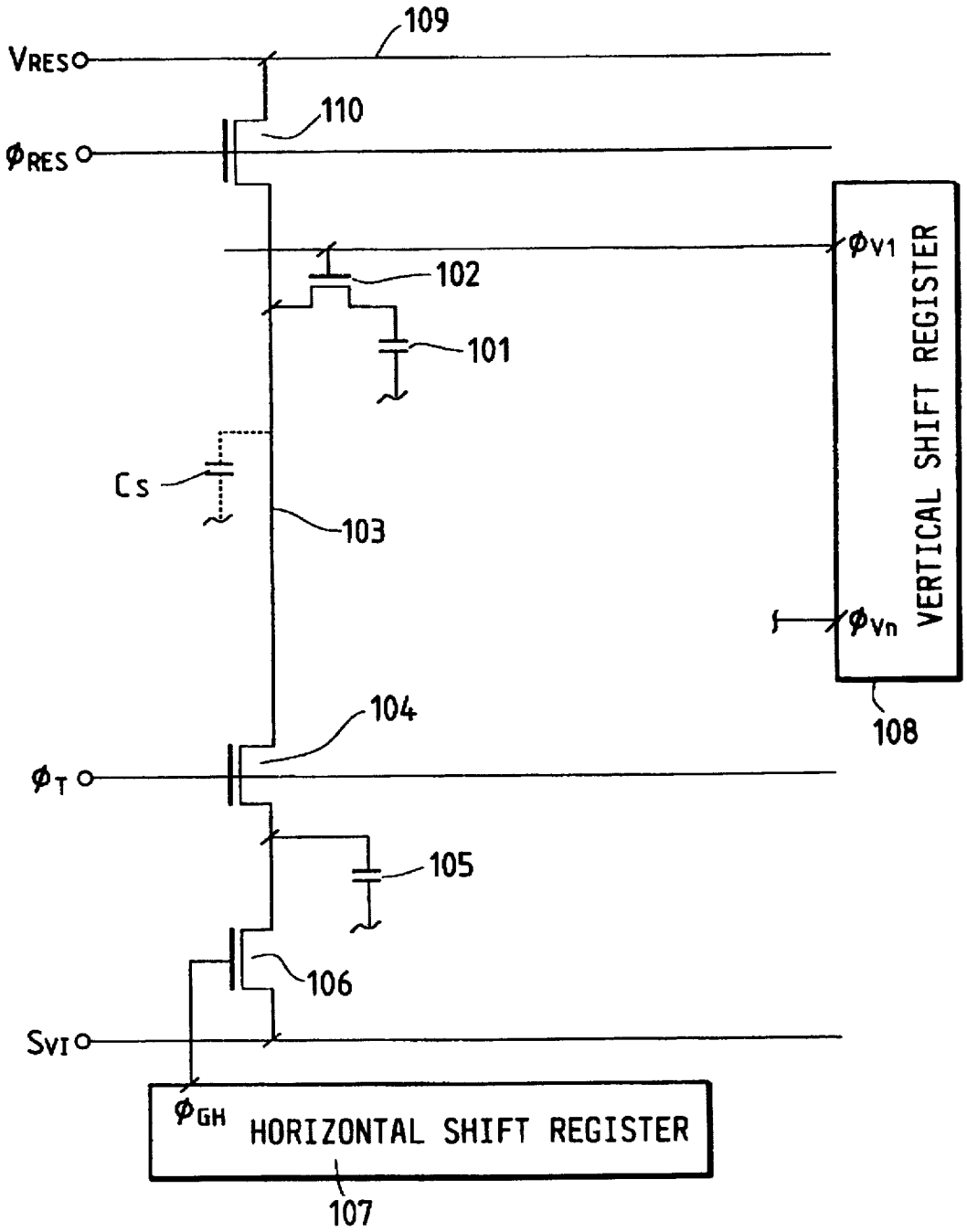
FIG. 14 is a circuit diagram of a liquid crystal display device constituting an embodiment 5 of the present invention.

FIG. 14 is a circuit diagram of the driving circuit of an active matrix liquid crystal device constituting the embodiment 5 of the present invention, wherein shown are a capacitance 101 of a liquid crystal cell; a pixel TFT 102 for applying a signal voltage to said liquid crystal cell; a signal line 103 for supplying the signal voltage to the liquid crystal cell of each pixel; a buffer capacitance 105; a switching TFT 106 for accumulating an external signal pulse $S_{VI}$ in a corresponding buffer capacitance 105; a horizontal shift register 107 for pulse driving the switching TFT's 106; a transfer gate 104 for supplying the external $S_{VI}$, accumulated in the buffer capacitance 105, to the signal line 103; a vertical shift register 108 for driving the pixel TFT's 102; a resetting signal line 109 connected to a fixed resetting bias source; and a switching TFT for avoiding electrical short-circuiting between the resetting signal line 109 and the recording signal line 103.

Figure 15:
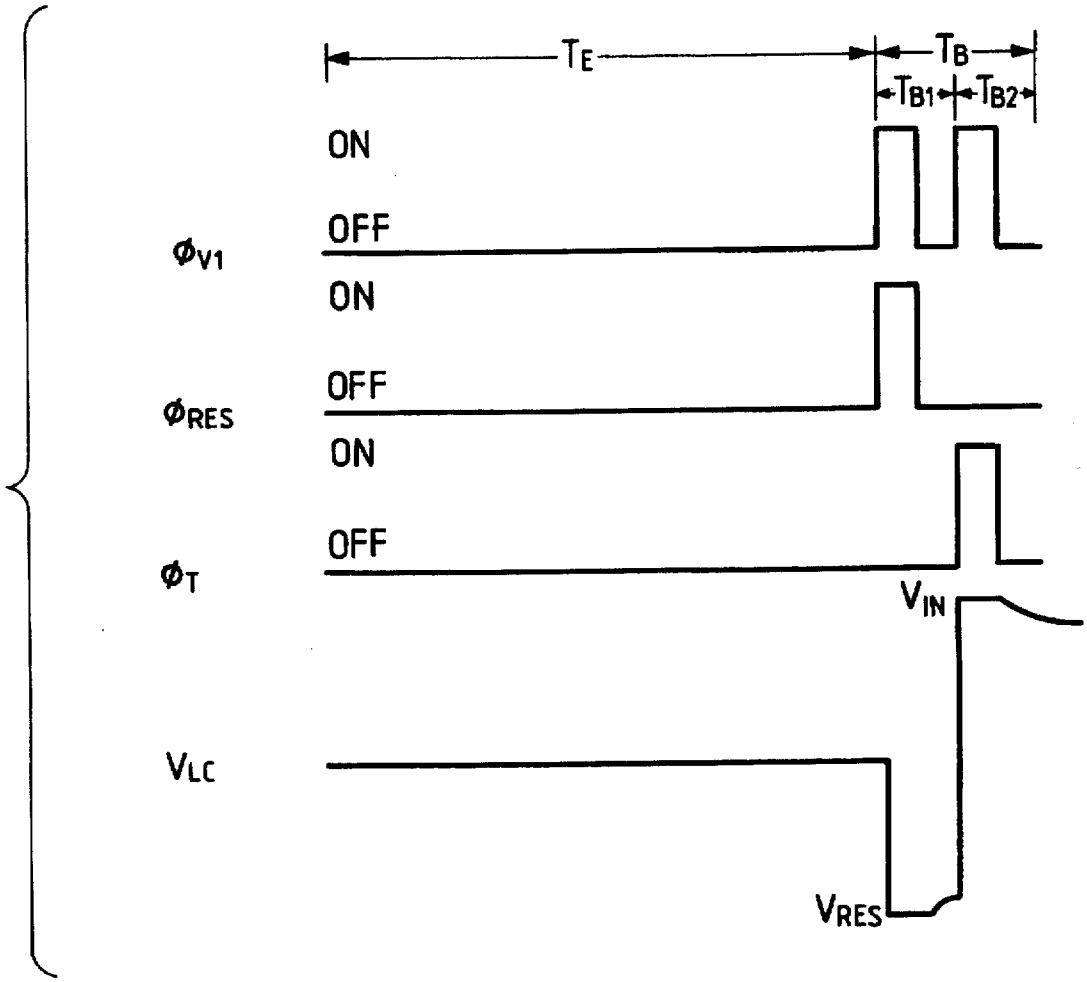
FIG. 15 is a timing chart for explaining the driving method for the liquid crystal display device of the embodiment 5.

FIG. 15 is a timing chart showing an example of the timings of pulses for applying a signal $V_{LC}$ to a pixel in an arbitrary line. Within a horizontal scanning period consisting of an effective scanning period $T_E$ and a blanking period $T_B$, the application of the resetting signal and the recording of the optical information signal can be executed within the blanking period $T_B$. The blanking period $T_B$ is divided into a first period $T_{B1}$ for the application of the resetting signal $T_{RES}$ and a second period $T_{B2}$ for the application of the optical information signal $V_{IN}$. Within said blanking period $T_B$, two signals, namely the resetting signal $V_{RES}$ and the optical information signal $V_{IN}$, are transmitted through the signal line 103, and these signals are differently handled by the on-off control of the switch TFT 110. A signal $\phi_{V1}$ from the vertical shift register 108 effects on-off control of the pixel TFT, while a signal $\phi_{RES}$ effects the on-off control of the switching TFT 110, and a signal $\phi_T$ effects the on-off control of the transfer gate 104.

For example, in a television display of the high definition format, about 2,000 pixels have to be driven per every horizontal line, but a horizontal line can be collectively reset by simultaneously driving all the TFT's by a single pulse in the first period $T_B$ of the blanking period $T_B$.

By driving an active matrix liquid crystal display device with the circuit configuration and the signal timings explained above, the resetting signal $V_{RES}$ can be supplied to each pixel without passing through the buffer capacitance but merely by charging the parasitic capacitance 111 actually associated with the signal line 111, so that a high-speed resetting can be realized.

Figure 16:
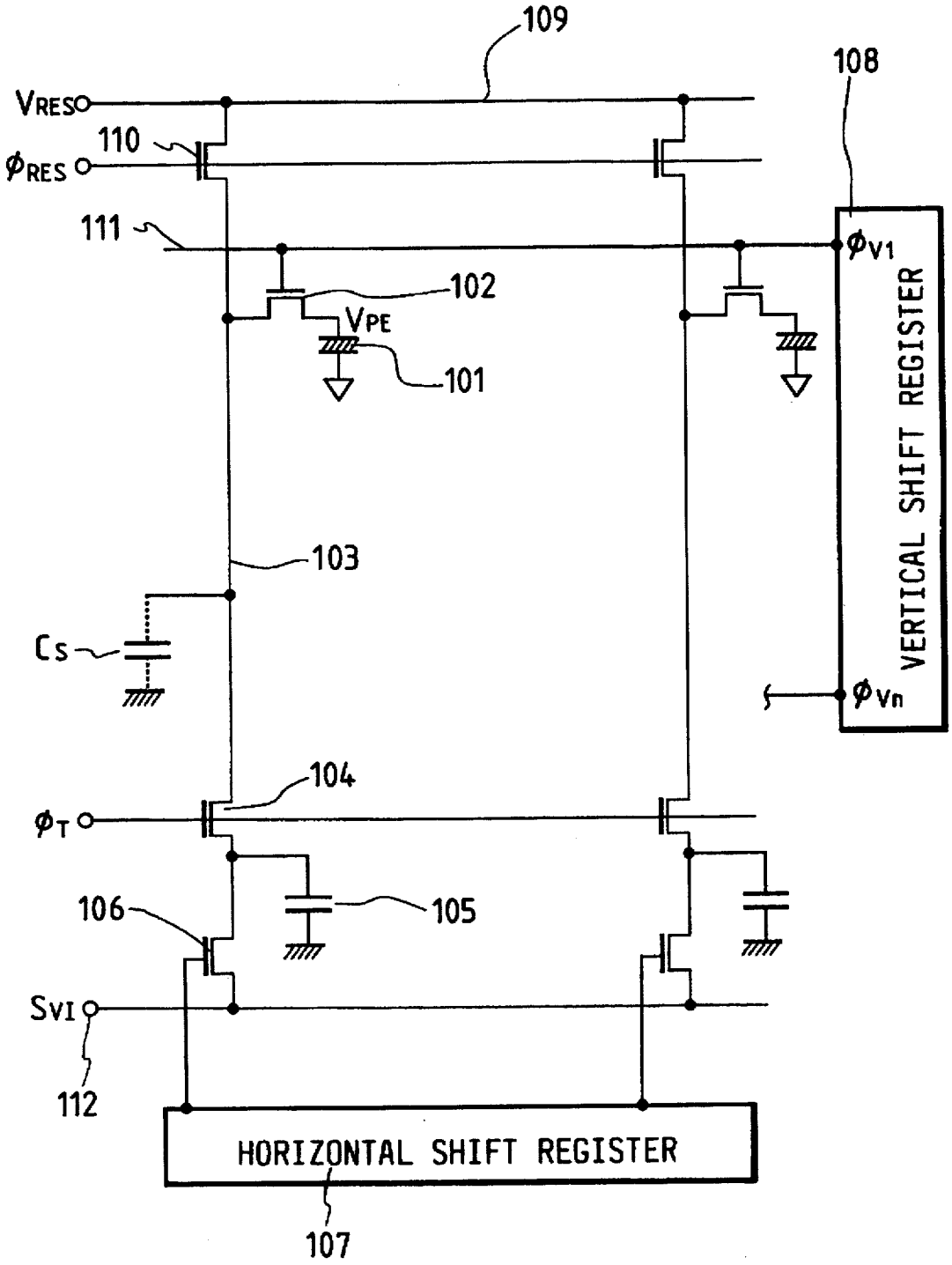
FIG. 16 is a circuit diagram of a liquid crystal display device constituting embodiments 6 to 8 of the present invention.

The timing of resetting is not limited to the case shown in FIGS. 15 and 16 in which the resetting signal is given to each pixel or each line immediately before the recording of optical information therein, but can be suitably selected according to the response of the liquid crystal material to be employed- For example, if the response of the liquid crystal material to be employed is slow, it is possible to provide a line with the resetting signal in advance, by a time corresponding to several scanning periods, prior to the recording of optical information therein, thereby giving an ample time for response.

In the embodiment 5 explained above, as the resetting signal is supplied, from an independent resetting voltage source, to the signal line through a path separate from the path for supply of the recording signal voltage to the pixels, the pixel resetting can be achieved with a higher speed in comparison with the conventional configuration in which the resetting signal is supplied through the buffer capacitance in the same manner as the recording signal.

Consequently, there can be provided an active matrix liquid crystal display device capable of high-speed operation, which can be used for constituting a flat display of direct observation type or a projection display, with a high definition. It is also possible to obtain a flat color television of transmissive or reflective type or a projection television, with a high definition, by providing the pixels respectively with different color filters, or by employing a plurality of the liquid crystal devices of the present invention and illuminating said devices with respectively different colored lights.

[Embodiment 6]

FIG. 16 shows a driving circuit for the active matrix liquid crystal device constituting an embodiment 6 of the present invention, wherein shown are a liquid crystal cell 101 represented by a capacitance associated therewith; a pixel TFT 102 for applying a signal voltage to said liquid crystal cell 101; a recording signal line 103; a transfer gate 104; a buffer capacitance 105; a switching TFT 106 for accumulating an external signal pulse in a corresponding buffer capacitance; a horizontal shift register 107 for pulse driving the switching TFT's 106; a vertical shift register 108 for driving the pixel TFT's 102; a gate signal line 110 for driving the pixel TFT's 102 by the output signals of the vertical shift register 108; a resetting line 109 connected to an unrepresented resetting voltage source; and a switching TFT 110 for selectively connecting the recording signal lines 103 with the resetting line 109.

In the following there will be explained, with reference to FIG. 17, the functions of the active matrix liquid crystal device employing the above-explained driving circuit and the TN liquid crystal, in line-sequential drive with signal inversion in every frame.

When image signals of a line are entered in succession from the input terminal 112, they are respectively transferred to the buffer capacitances 105 through the switching TFT's 106 which are turned on by the horizontal shift register 107 driven by the pulses synchronized with the frequency of said image signals. Within so-called blanking period $t_B$ which is after the transfer of the last bit of the line to the buffer capacitance 105 ($t_1$ in FIG. 17) but before the entry of the image signals of a next line to the input terminal 112 and during which the switching TFT's 116 are turned off, the switching TFT's 110 and the pixel TFT's 102 are simultaneously turned on ($t_2$) while the transfer gates 104 are turned off, thereby resetting the pixel electrodes from the signal voltages to the pixel resetting voltage $V_{RES}$. The resetting voltage $V_{RES}$ is usually selected between the maximum value $V_{MAX}$ of the signal voltage and the inverted value $-V_{MAX}$ thereof, commonly at the middle thereof. The pixel resetting operation is executed in a part of the blanking period. The resetting period, in which the switching TFT's 110 are turned on ($t_R = t_3 - t_2$), should be at least enough for charging the parasitic capacitance $C_S$ of the signal line 103 and the pixel capacitance 101 of the pixel to be reset. In the remaining part of the blanking period, after the switching TFT's 110 are turned off, the transfer gates 104 are turned on ($t_4$) thereby transferring the signals from the buffer capacitances to the respective pixels, and the pixel TFT's 102 and the transfer gates 104 are turned off before the end of the blanking period ($t_5$). As a result, each pixel electrode is reset once during the change from the signal voltage of the present to the inverted signal voltage in the next frame, so that the on-state source-drain bias applied to the pixel TFT 102 does not exceed $V_{MAX}$.

Figure 17:
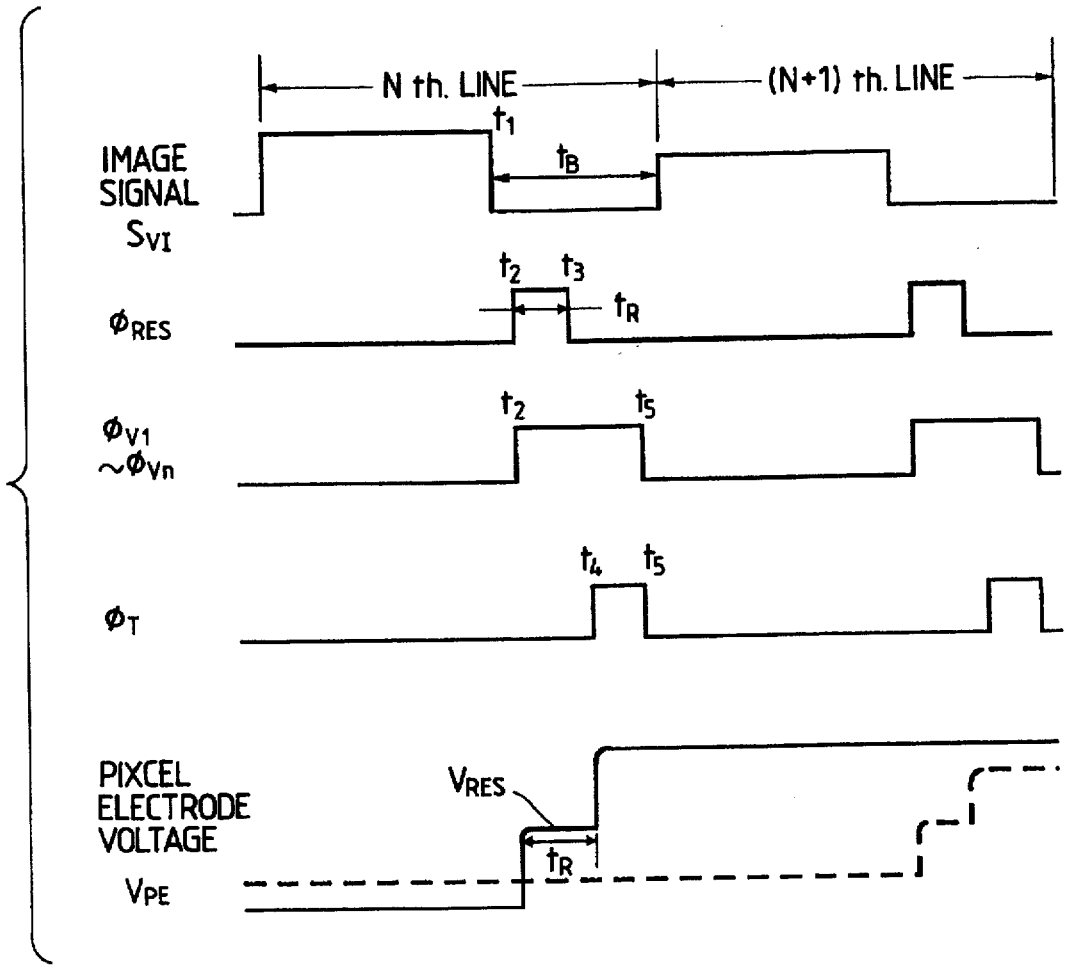
FIG. 17 is a timing chart for explaining the driving method for the liquid crystal display device of the embodiment 6.

The above-explained timings are shown in FIG. 17, wherein shown are the image signals $S_{VI}$ of the N-th and (N+1)-th lines; gate input signals $\phi_{RES}$, $\phi_{V1}$–$\phi_{Vn}$ respectively of the switching TFT's 110 and the pixel TFT's 102; the input signal $\phi_T$ of the transfer gates 104; and the signal voltages of the pixels of the N-th line (solid line) and the (N+1)-th line (broken line). As will be apparent from the charts, the pixel electrode is maintained at the resetting voltage $V_{RES}$ in the course of change from the signal voltage to the next inverted signal voltage, whereby the on-state source-drain bias applied to the pixel TFT is alleviated.

In the following there is considered the variation in the signal voltage under the above-explained situation. The period $t_R$, in which the pixel voltage is maintained at the set level, is in the order of microseconds less than the blanking period, and the liquid crystal molecules do not respond to such voltage variation within such short period. In this state, with the resetting potential $V_{RES}$, the effective voltage $V_{rms}$ actually applied to the liquid crystal can be represented as follows, based on the foregoing equation (1):

$$V_{rms} = \sqrt{\frac{1}{t_F}\int_0^{t_F-2t_R}(V_{LC}(t)-V_{COM})^2\,dt+\frac{1}{t_F}\int_0^{2t_R}(V_{LC}(t)-V_{COM})^2\,dt} \quad (12)$$

Consequently the curve representing the relationship between the transmittance (T) and the effective voltage ($V_{rms}$) is displaced by the contribution of the resetting voltage $V_{RES}$, but the image is not influenced if $t_R$ is sufficiently negligibly with respect to a frame period. For example, in the high definition television image signal, a frame period is about 33 msec, and a blanking period therein is about 3 μsec. In the blanking period, the period required for pixel resetting is about 1 μsec. Consequently the pixel electrodes are maintained at the resetting potential $V_{RES}$ for 2/33000 of a frame period, but is maintained at the signal voltage $V_{LC}$ for 32998/33000 of the frame period, so that the influence to the image is extremely small.

Also as explained above, the curve representing the relationship between the transmittance T and the effective voltage $V_{rms}$ is displaced by the contribution of $V_{RES}$, but the effective voltage $V_{rms}$ is uniquely determined by a given value of $V_{LC}$, as long as the resetting voltage $V_{RES}$ and the resetting time $t_R$ are constant. Consequently the characteristics of the display device may be determined, based on thus displaced curve. It is also possible to cancel the displacement by the regulation of the original signal voltage $V_{LC}$.

Since the bias voltage applied to the pixel TFT's is reduced as explained above, the vertically streaking smear, resulting from the swing of the signal voltage of each pixel, under the influence of signals in other pixels connected to a same signal line, is eliminated and the image quality is therefore improved.

[Embodiment 7]

Figure 18:
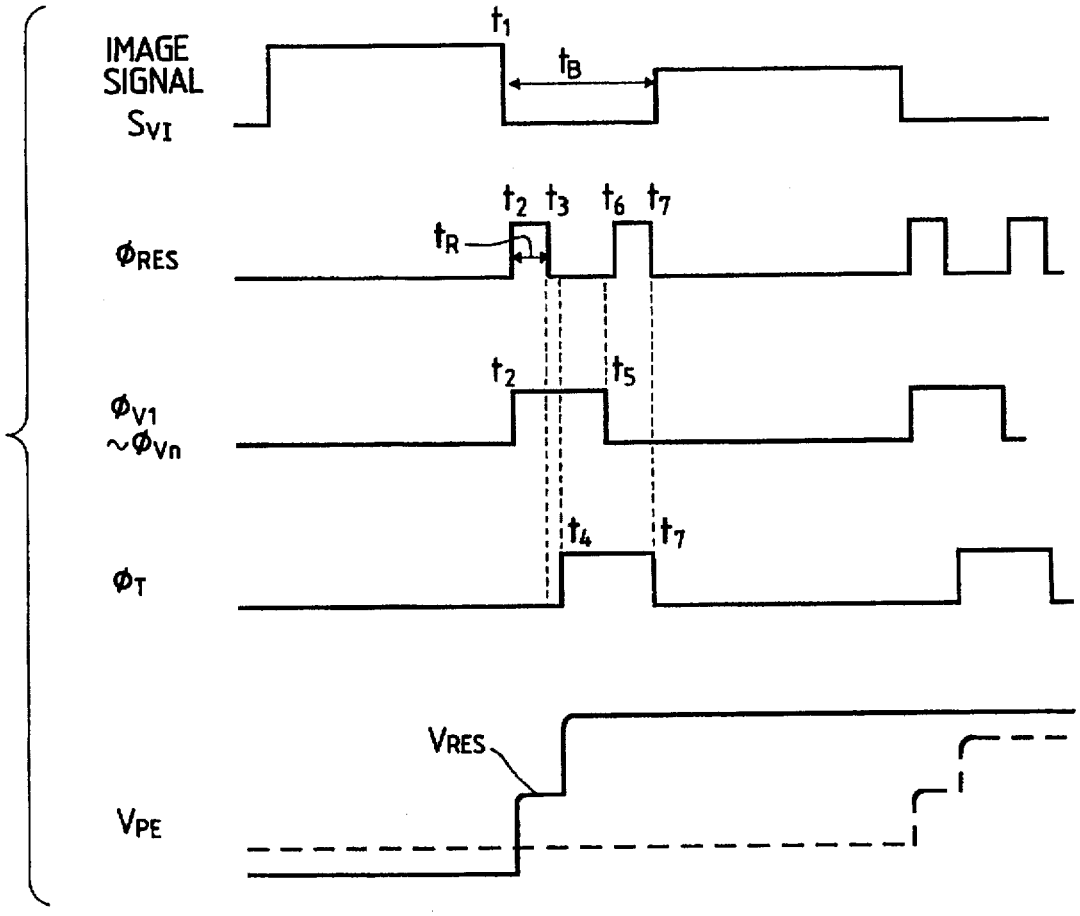
FIG. 18 is a timing chart for explaining the driving method for the liquid crystal display device of the embodiment 7.

FIG. 18 is a timing chart of an embodiment 7, utilizing also the circuit shown in FIG. 16. In this embodiment 7, after the switching TFT's 106 are turned off ($t_1$) upon completion of the image signals to the buffer capacitance 105, the switching TFT's 110 and the pixel TFT's are simultaneously turned on ($t_2$) while the transfer gates 104 are turned off, thereby resetting the pixel electrodes from the signal voltages to the pixel resetting voltage. Then the switching TFT's 110 are turned off ($t_3$) while the pixel TFT's 102 are turned on, and the transfer gates 104 are turned on ($t_4$) to transfer the signals from the buffer capacitances 105 to the respective pixels 101. The above-explained operations are the same as those in the embodiment 1. However, when the pixel TFT's 102 are turned off ($t_5$) after the signal transfer to the pixels 101, the transfer gates 104 are not turned off simultaneously but maintained in on-state, and the switching TFT's 110 are again turned on ($t_5$), thereby resetting the buffer capacitances 105 also to the reset voltage $V_{RES}$.

In the foregoing embodiment 6, signals inverted every frame are supplied from the input terminal 112 to the buffer capacitances 105 through the switching TFT's 106, and, in such signal supply, an on-state source-drain bias voltage of $2V_{MAX}$ at maximum is applied to the switching TFT's in a similar manner as in the pixel TFT's 102 in the conventional configuration. However, with the timings shown in FIG. 18, the potential of the buffer capacitances 105 is reset in the course of change from the signal voltages to the next inverted signal voltages, so that the on-state source-drain voltage resistance can be reduced not only in the pixel TFT's 102 but also in the switching TFT's 110. The on-state of the switching TFT's 110 required for the resetting of the buffer capacitances 105 should be at least enough for charging the parasitic capacitances of the signal lines 103 lines 103 and the buffer capacitances 105. The switching TFT's 110 and the transfer gates 104 are turned off before the end of the blanking period. As a result the on-state source-drain bias applied to the pixel TFT's 106 is also alleviated.

In FIG. 18 there are shown the image signals $S_{VI}$ of the N-th and (N+1)-th lines; the gate input signals $\phi_{RES}$, $\phi_{V1}$–$\phi_{Vn}$ respectively of the switching TFT'S 106 and the pixel TFT's 102; the transfer gate input signal $\phi_T$; and the signal voltages of the pixels in the N-th line (solid line) and in the (N+1)-th line (broken line). As will be apparent from these charts, the pixel electrode is maintained once at the resetting voltage in the course of change from the signal voltage to the next inverted signal voltage, whereby the on-state source-drain bias is alleviated not only the pixel TFT's 102 but also in the switching TFT's 110.

[Embodiment 8]

Figure 19:
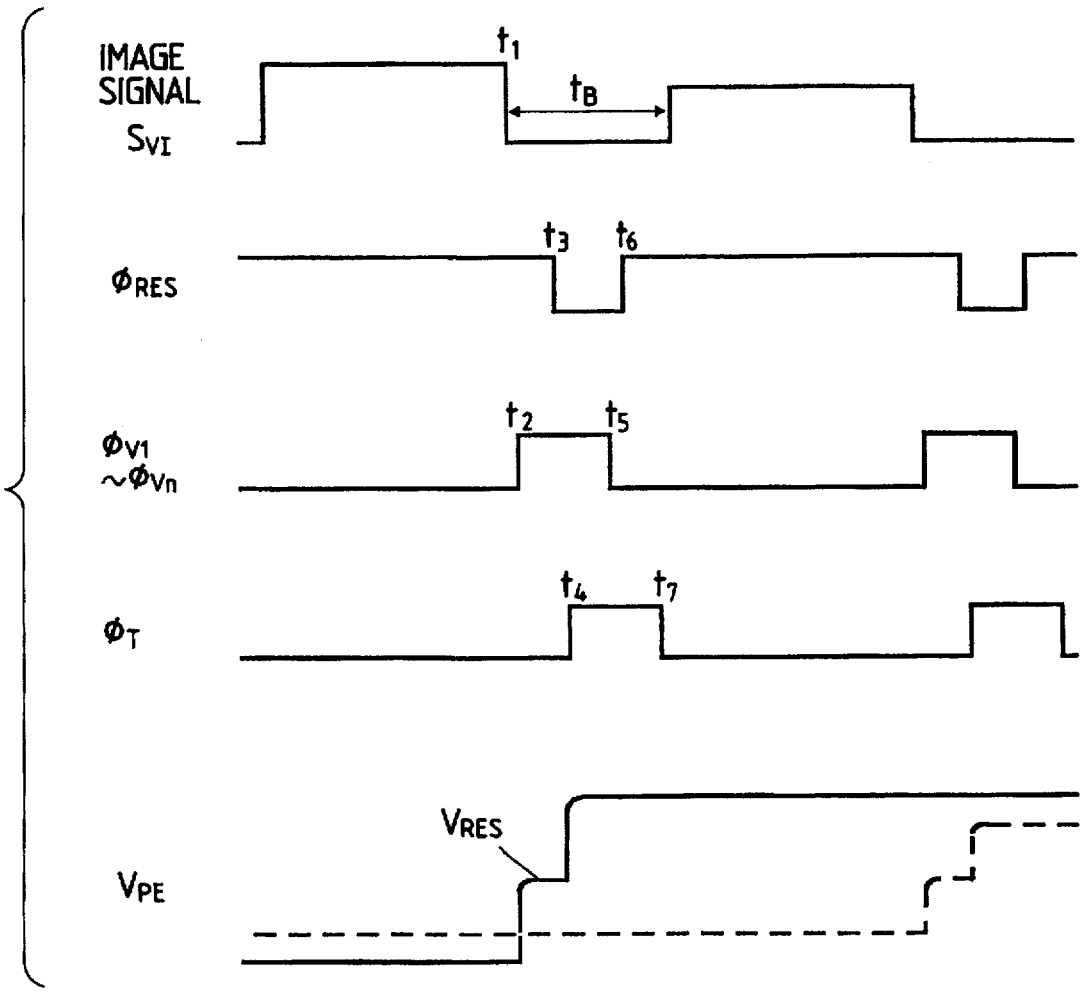
FIG. 19 is a timing chart for explaining the driving method for the liquid crystal display device of the embodiment 8.

FIG. 19 is a timing chart of an embodiment 8 also utilizing the circuit shown in FIG. 16. In this embodiment, in the blanking period $t_B$ after the switching TFT's 106 are turned off ($t_1$) upon completion of transfer of the image signals of a line to the buffer capacitances 105, the pixel TFT's 102 are turned on ($t_2$) while the transfer gates are maintained turned off. The switching TFT's 110 are already turned on from the horizontal scanning period, thereby resetting the pixel electrodes from the signal voltages to the resetting voltage $V_{RES}$. The resetting voltage $V_{RES}$ is selected between the maximum value $V_{MAX}$ of the signal voltage and the inverted voltage $-V_{MAX}$ thereof, normally at the middle thereof. The pixel resetting operation is executed in a part of the blanking period. The on-state period of the switching TFT's 110 should be at least enough for charging the parasitie capacitances $C_S$ of the signal lines 103 and the pixel capacitances 101 to be reset. In the remaining part of the blanking period after the switching TFT's 110 are turned off ($t_3$), the transfer gates 104 are turned on while the pixel TFT's 102 are maintained turned on ($t_4$), thereby transferring the signals from the buffer capacitances 105 to the respective pixels 101. After the signal transfer, the pixel TFT's 102 are turned off ($t_5$) while the transfer gates 104 are maintained in the on-state, and the switching TFT's 110 are again turned on ($t_6$) thereby resetting the buffer capacitances 105 also to the resetting potential. Then the transfer gates 104 are turned off ($t_7$) before the end of the blanking period. The switching TFT's 110 are still maintained in the on-state during a horizontal scanning period, in order to maintain the signal lines 103 at a constant voltage.

In FIG. 19, there are shown the image signals $S_{VI}$ of the N-th and (N+1)-th lines; the gate input signals $\phi_{RES}$, $\phi_{V1}$–$\phi_{Vn}$ respectively of the switching TFT's 110 and the pixel TFT's 102; the input signal $\phi_T$ of the transfer gates; and the signal voltages of the pixels of the N-th line (solid line) and the (N+1)-th line (broken line). As will be apparent from these charts, the pixel electrodes are maintained once at the resetting voltage in the course of change from the signal voltages to the next inverted signal voltages, so that the on-state source-drain bias is alleviated not only in the pixel TFT's 102 but also in the switching TFT's 106.

Thus the present embodiment not only reduces the requirements for the voltage resistance of TFT's but also suppresses the aforementioned variation in the signal voltage.

More specifically, the signal voltage in each pixel is no longer influenced by those in other pixels connected to the same signal line, whereby the vertically streaking smear can be eliminated and the image quality is therefore improved.

[Embodiment 9]

Figure 20:
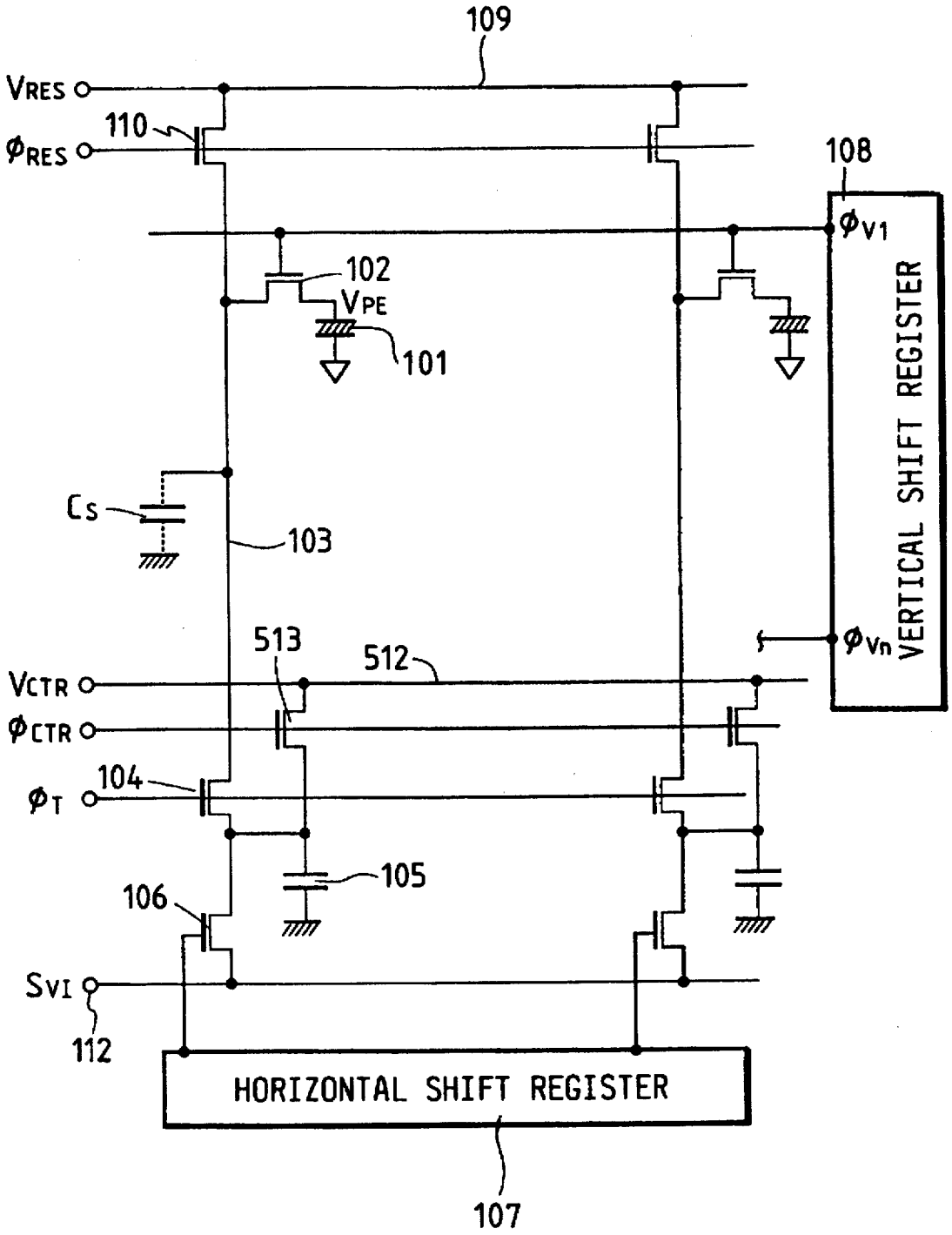
FIG. 20 is a circuit diagram of a liquid crystal display device constituting embodiments 9 and 10 of the present invention.

FIG. 20 is a circuit diagram of a driving circuit for the active matrix liquid crystal device constituting an embodiment 9 of the present invention. The circuit shown in FIG. 20 is obtained by adding, to the circuit shown in FIG. 16, a second resetting circuit for resetting the buffer capacitances 105. The second resetting circuit is similar to the aforementioned resetting circuit for resetting the pixel potential, and is composed of a resetting line 512 connected to a buffer capacitance resetting power source, and switching TFT's 513 for connecting the resetting line 512 selectively with the recording signal lines 103.

In the following there will be explained, with reference to FIG. 21, the functions of an active matrix liquid crystal device employing TN liquid crystal, in a line-sequential drive with inversion of polarity in every frame.

When the image signals of a line are entered in succession from the input terminal 112, the signals are transferred to the buffer capacitances 105 by the switching TFT's 106 turned on by the horizontal shift register 107 which is driven by the pulses synchronized with the frequency of the signals. In the so-called blanking period $t_B$ which is after the transfer of the signal of the last bit of the line into the buffer capacitance ($t_1$ in FIG. 21) but prior to the entry of the image signals of a next line into the input terminal 112, the pixel TFT's 102 are turned on ($t_2$). The switching TFT's 110 are already in the on-state from the preceding horizontal scanning period, whereby the pixel electrodes are reset from the signal voltages to the pixel resetting voltage $V_{RES}$. The resetting voltage is selected between the maximum value $V_{MAX}$ of the signal voltage and the inverted value $-V_{MAX}$ thereof, generally at the middle thereof. The pixel resetting operation is executed in a part of the blanking period. The on-period of the switching TFT 110 should be at least enough for charging the parasitic capacitance $C_S$ of the signal line 103 and the pixel capacitance 101 of the pixel to be reset. In the remaining part of the blanking period after the switching TFT's 110 are turned off ($t_3$), the transfer gates 104 are turned on ($t_4$) to transfer the signals from the buffer capacitances 105 to the respective pixels. After the signal transfer, the pixel TFT's 102 and the transfer gates 104 are turned off ($t_5$, $t_7$). Subsequently the switching TFT's 513 are turned on ($t_8$), thereby resetting the buffer capacitances 105 also. Then, after the TFT's 513 are turned off ($t_9$), the switching TFT's 110 are turned on ($t_{10}$).

In this embodiment, since the resetting of the pixel 101 and the signal line 103 is executed by the switching TFT 110 while the resetting of the accumulating capacitance 105 is executed by the separate TFT 513, so that the loads on these TFT's can be alleviated and the resetting operation can be achieved with a higher speed.

Figure 21:
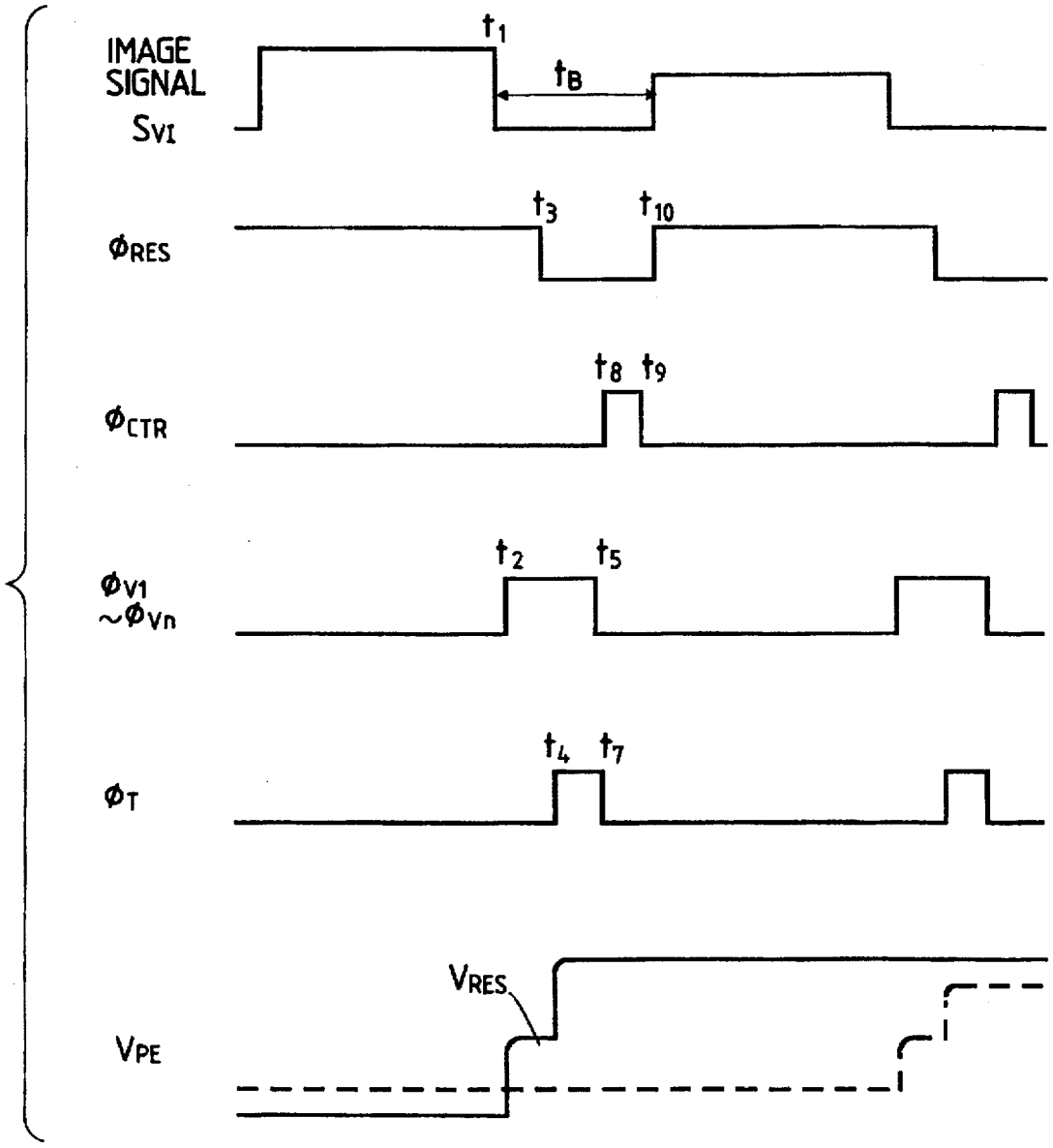
FIG. 21 is a timing chart for explaining the driving method for the liquid crystal display device of the embodiment 9.

FIG. 21 shows the timings of functions of the present embodiment. In FIG. 21 there are shown the image signals $S_{VI}$ of the N-th and (N+1)-th lines; the gate input signals $\phi_{RES}$, $\phi_{V1}$–$\phi_{Vn}$ respectively of the switching TFT 110 and the pixel TFT 102; the input signal $\phi_T$ of the transfer gate 104; the pixel signals voltages $V_{PE}$ of the N-th line (solid line) and the (N+1)-th line (broken line); and the gate input signal $\phi_{CTR}$ of the switching TFT 513. As will be apparent from these charts, the pixel electrode is once maintained at the resetting voltage in the course of change from the signal voltage to the next inverted signal voltage, whereby the on-state source-drain bias is alleviated not only in the pixel TFT 102 but also in the switching TFT 106.

[Embodiment 10]

Figure 1:
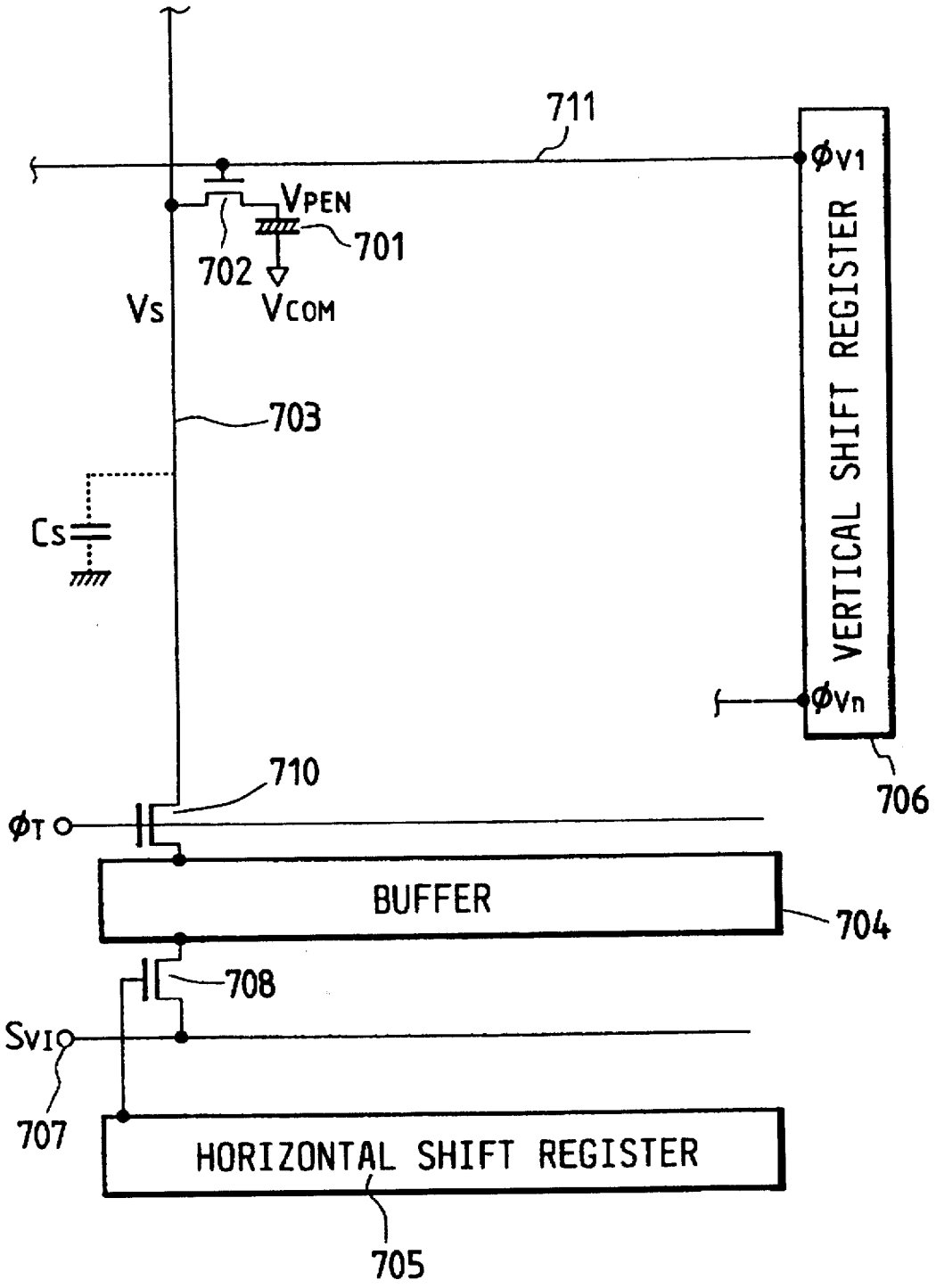
FIG. 1 PRIOR ART
FIG. 1 is a circuit diagram of a conventional active matrix liquid crystal display device.
Figure 2:
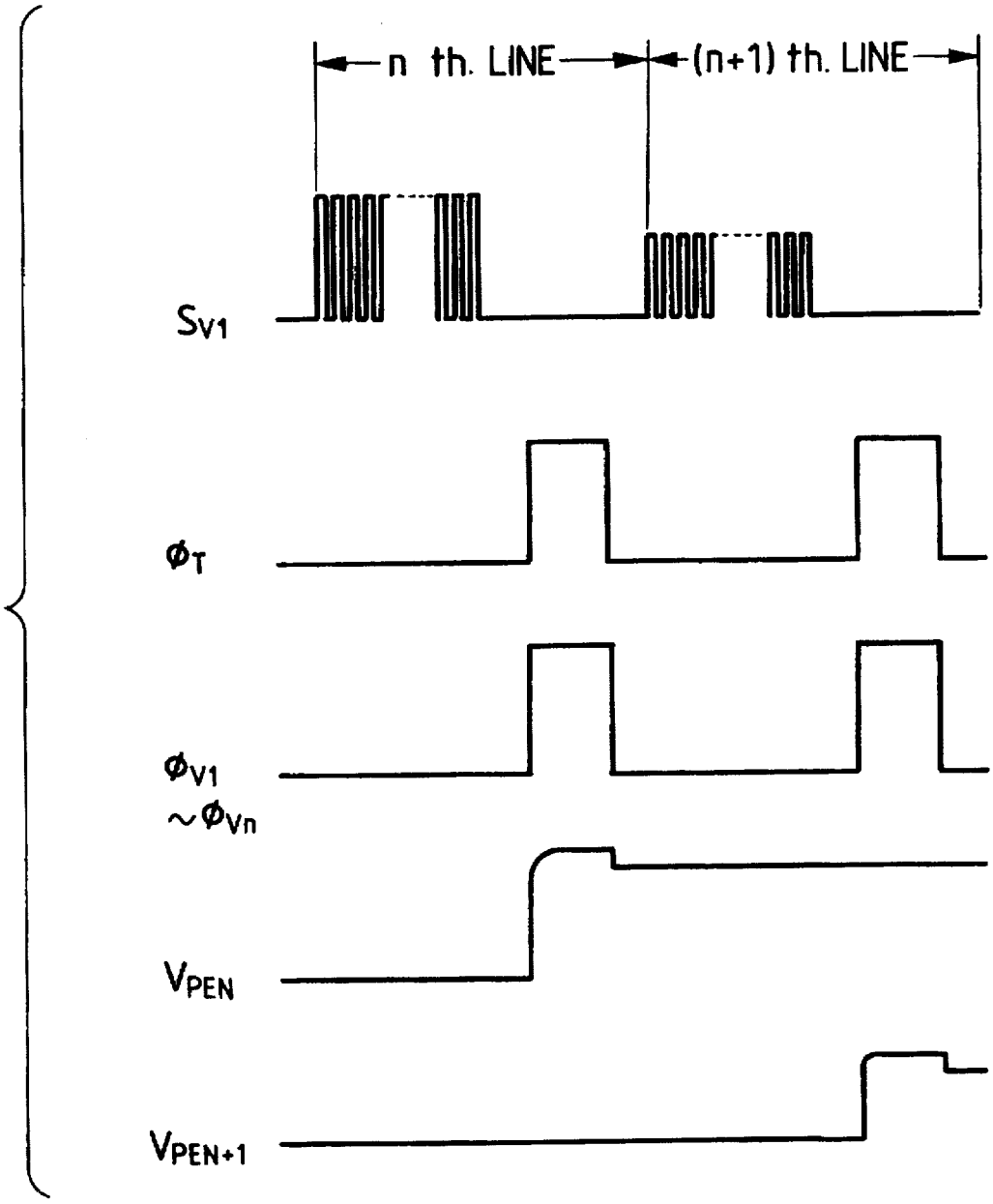
FIG. 2 PRIOR ART
FIG. 2 is a timing chart showing the driving method for the device shown in FIG. 1.
Figure 3:
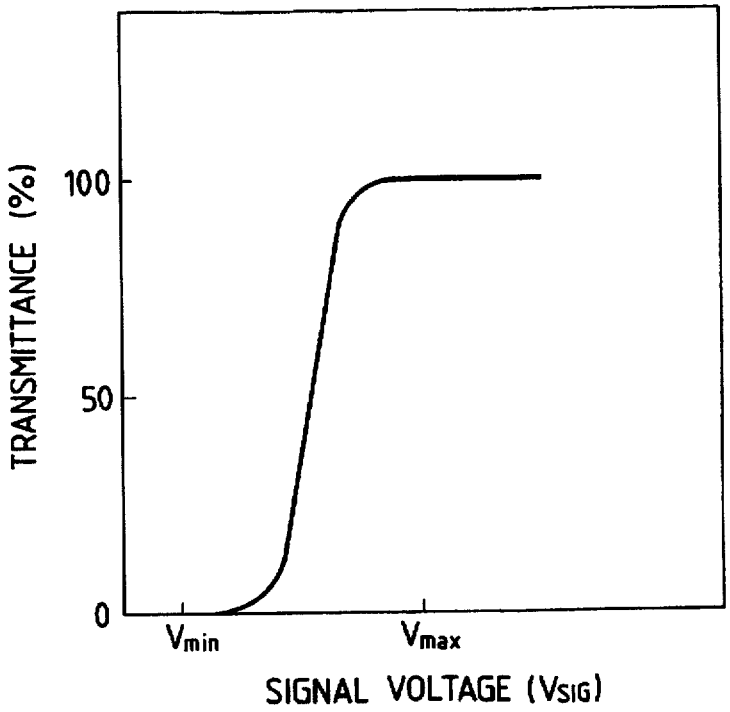
FIG. 3 is a chart showing the relationship between the transmittance and the signal voltage in a liquid crystal display device.
Figure 4A:
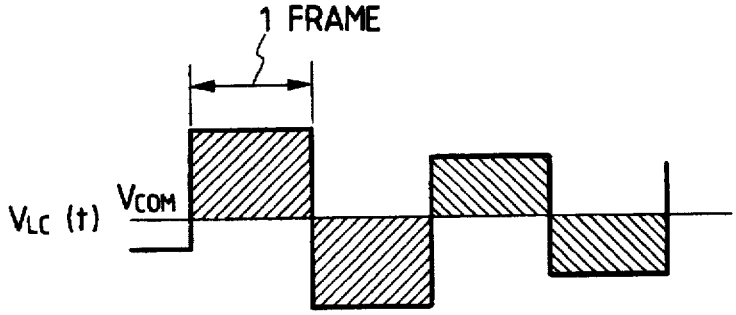
FIG. 4A PRIOR ART
FIGS. 4A and 4B are timing charts showing an example of the conventional driving signal.
Figure 4B:
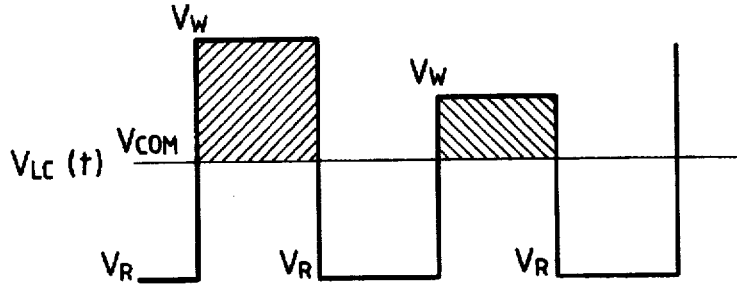
FIG. 4B PRIOR ART
Figure 5:
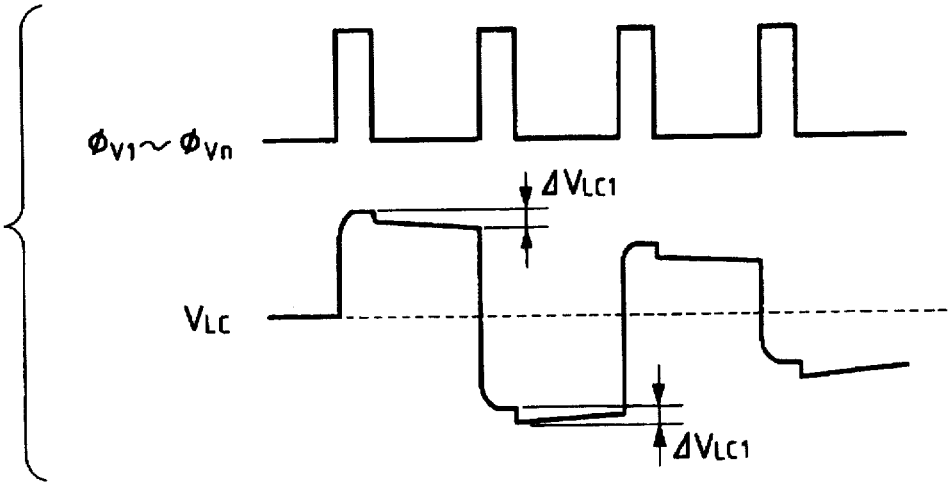
FIG. 5 PRIOR ART
FIGS. 5 and 6 are timing charts for explaining the variation in the voltage applied to the pixels in conventional liquid crystal display devices.
Figure 6:
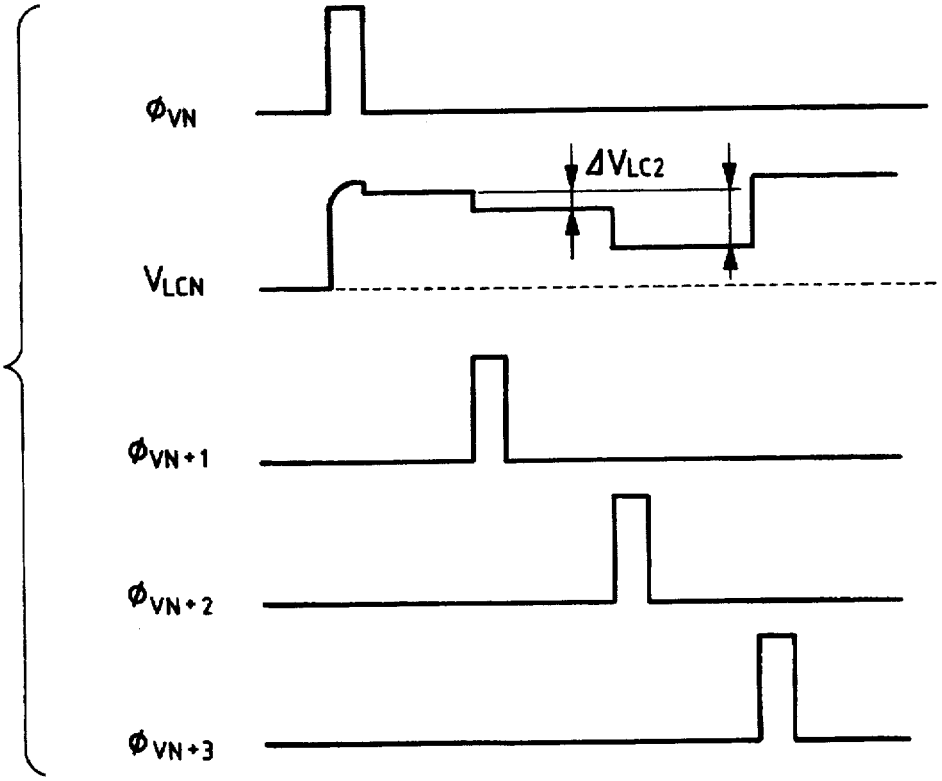
FIG. 6 PRIOR ART
Figure 7:
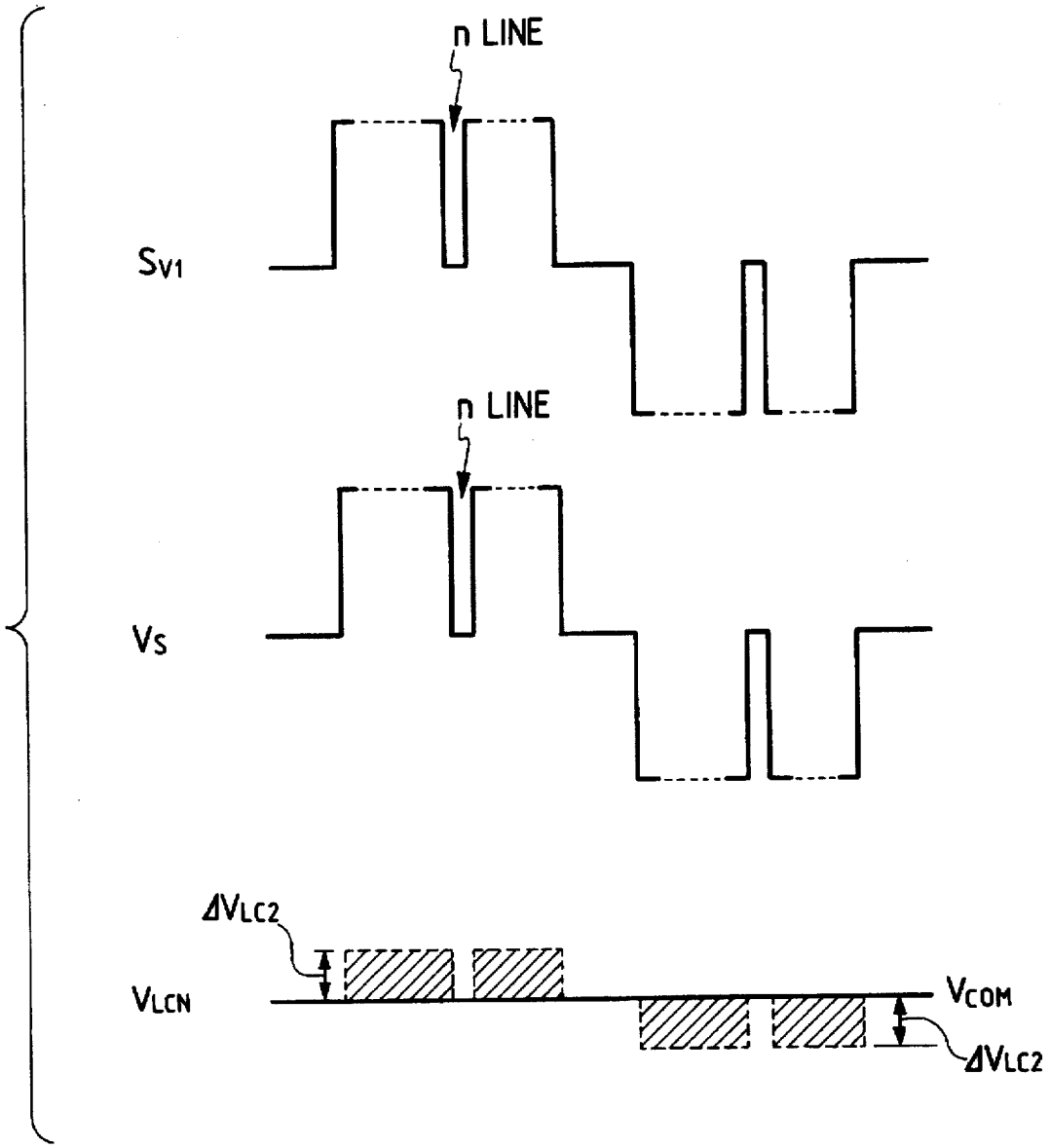
FIG. 7 is a timing chart showing another example of the conventional driving signal.
Figure 22:
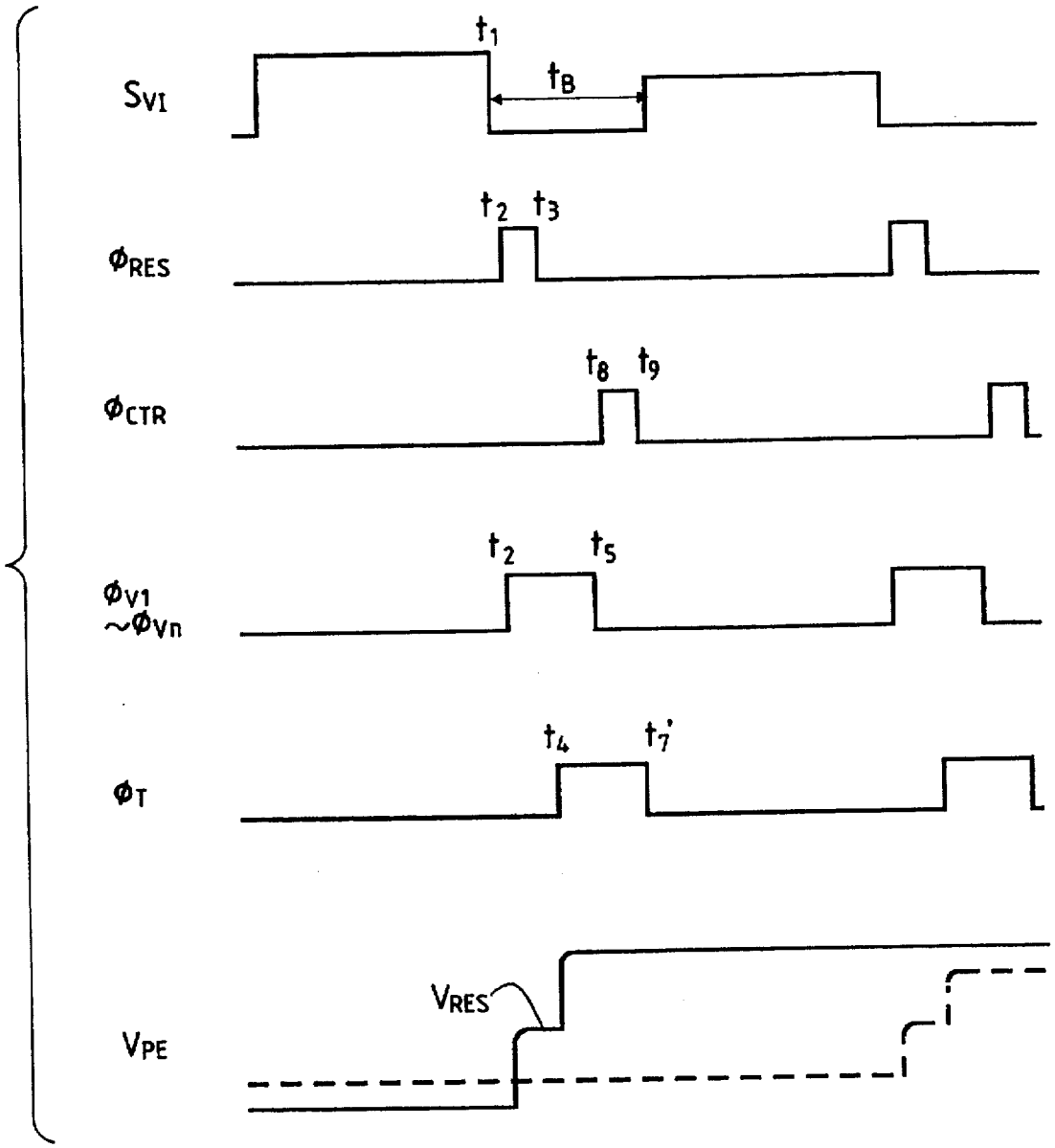
FIG. 22 is a timing chart for explaining the driving method for the liquid crystal display device of the embodiment 10.

FIG. 22 shows the function timings constituting an embodiment 1 utilizing the circuit shown in FIG. 20. The embodiment 1 on the circuit shown in FIG. 20 corresponds to the functions shown in FIG. 3 on the circuit shown in FIG. 1, and the resetting operation of the buffer capacitances 105 is effected by the switching TFT's 513 instead of the switching TFT 110 in case of FIG. 18.

In the embodiment shown in FIGS. 20 and 22, when the image signals of a line are entered in succession from the input terminal 112, the signals are transferred to the buffer capacitances 105 by the switching TFT's 106 turned on by the horizontal shift register 107 which is drive by pulses synchronized with the frequency of the image signals. In the so-called blanking period $t_B$ which is after the transfer of the signal of the last bit of the line into the buffer capacitance ($t_1$) but before the entry of the image signals of a next line into the input terminal 112, the switching TFT's 110 and the pixel TFT's 102 are simultaneously turned on while the transfer gates 104 are maintained in the off-state ($t_2$), whereby the pixel electrodes are reset from the signal voltages to the pixel resetting voltage $V_{RES}$. Then the switching TFT's 110 are turned off ($t_3$) while the pixel TFT's 102 are maintained in the on-state, and the transfer gates 104 are turned on ($t_4$), thereby transferring the signals from the buffer capacitances 105 to the respective pixels 101. After the signal transfer to the pixels 101, the pixel TFT's 102 are turned off ($t_5$), and the switching TFT's 513 are turned on ($t_8$). Thus the buffer capacitances 105 and the parasitic capacitances 113 are reset to the potential of the buffer capacitances, which is equal to the potential of the resetting line 512. Subsequently the transfer gates 104 and the switching TFT's 513 are turned off ($t_7$, $t_9$) within the remaining part of the blanking period $t_B$.

In the present embodiment, as in the embodiment 9, the loads on the TFT's for resetting the pixel capacitance 101 and the buffer capacitance 105 can be alleviated, so that the resetting operation can be achieved with a higher speed. Also the on-state source-drain bias can be reduced in the pixel TFT's 102 and in the switching TFT's 106.

[Embodiment 11]

In the foregoing embodiments 6 to 10, the active matrix is driven by a line-sequential driving method for every horizontal line, but similar effects can also be attained in a pixel-sequential drive.

Figure 23:
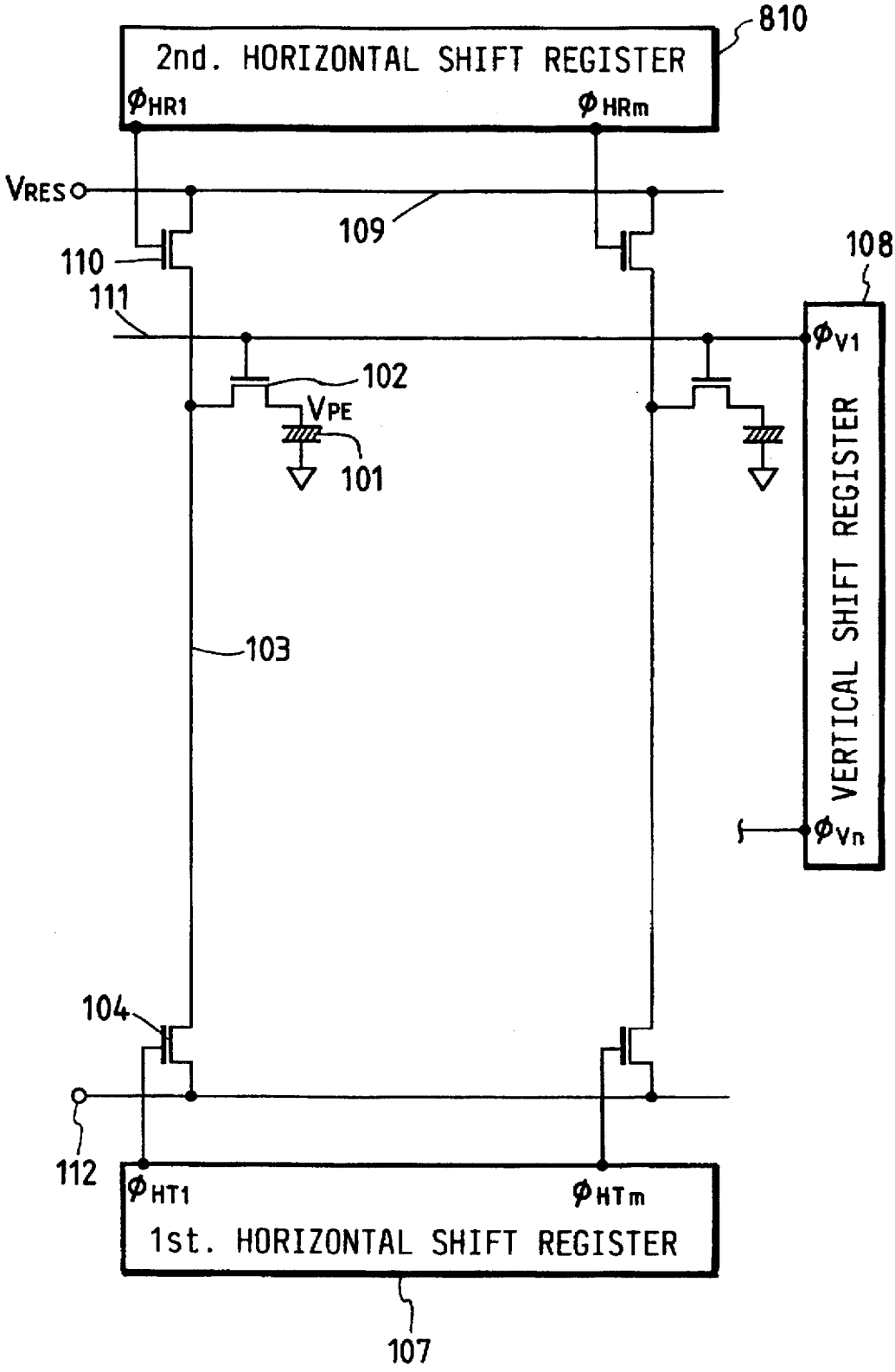
FIG. 23 is a circuit diagram of a liquid crystal display device constituting an embodiment 11 of the present invention.

FIG. 23 shows a driving circuit for the sequential-drive active matrix liquid crystal device of the present embodiment, wherein shown are a capacitance 101 of a liquid crystal cell; a pixel TFT 102 for applying a signal voltage to the liquid crystal cell 101; a signal line 103; a switching TFT 104 for accumulating an external signal pulse in a corresponding liquid crystal cell capacitance; a first horizontal shift register 107 for pulse driving the switching TFT's 104; a vertical shift register 108 for driving the pixel TFT's; a resetting line 109 connected to a pixel resetting source; a switching TFT 110 for selectively connecting the resetting line 109 with the recording signal line 103; and a second horizontal shift register 810 for driving the switching TFT's 110.

In the following there will be explained, with reference to FIG. 24, the functions of the circuit shown in FIG. 23.

Figure 24:
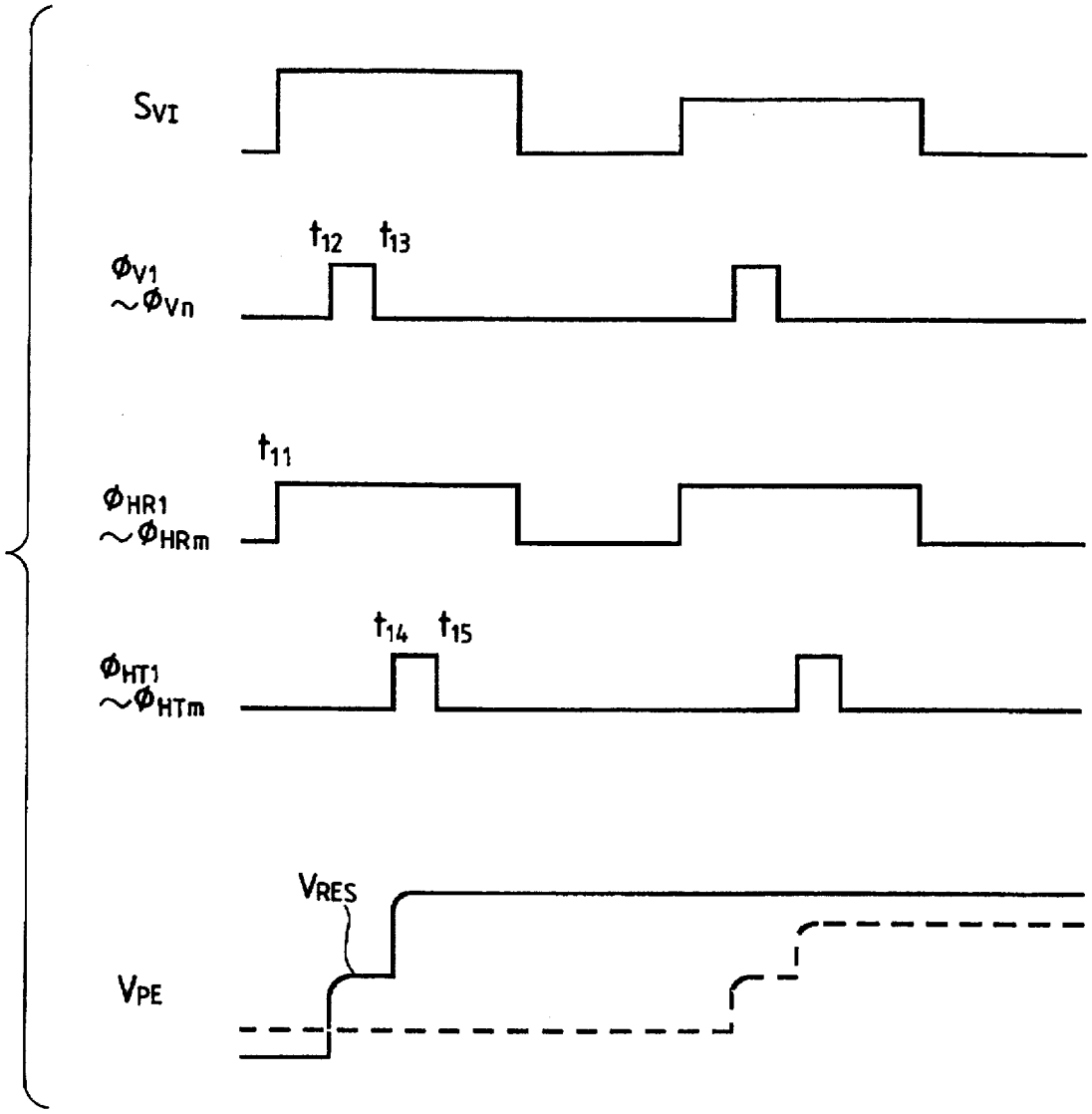
FIG. 24 is a timing chart for explaining the driving method for the liquid crystal display device of the embodiment 11.

At first the pixel TFT's 102 of a line selected by the vertical shift register 108 are turned on ($t_{11}$ in FIG. 24). Then the second shift register 810 in succession turns on the switching TFT's 110 ($t_{12}$), thereby resetting the pixels 101 to the resetting potential $V_{RES}$. After the resetting the TFT's 110 are turned off ($t_{13}$), and the image signals of a line are entered in succession from the input terminal 112 and are transferred, in succession, to all the pixels of a horizontal line through the switching TFT's 104, which are turned on by the first horizontal shift register 107 driven by pulses synchronized with the frequency of the image signals ($t_{14}$–$t_{15}$).

Figure 25:
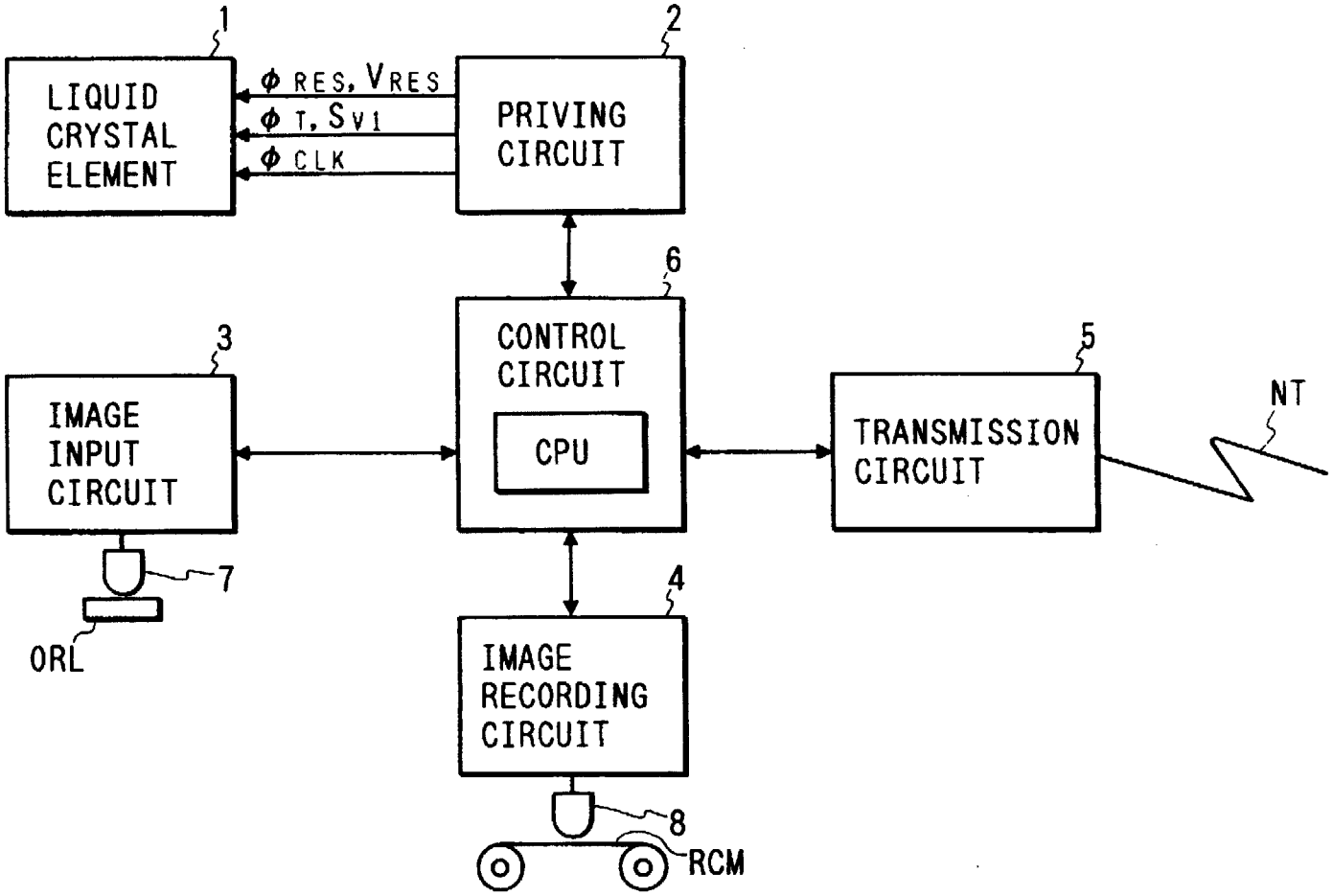
FIG. 25 is a schematic view of a liquid crystal device of the present invention.

FIG. 25 shows the function timings of the present embodiment. In FIG. 25 there are shown the image signals $S_{VI}$ of the N-th and (N+1)-th lines; the gate input signals $\phi_{V1}$–$\phi_{Vn}$, $\phi_{HR1}$–$\phi_{HRm}$, $\phi_{HT1}$–$\phi_{HTm}$ respectively of the pixel TFT's 102, switching TFT's 110 and transfer gates 104; and the pixel signal voltages $V_{PE}$ of the N-th line (solid line) and the (N+1)-th line (broken line). As will be apparent from these charts, the pixel electrode is once maintained at the resetting voltage in the course of change from the signal voltage to the next inverted signal voltage, whereby the on-state source-drain bias applied to the pixel TFT's 102 is alleviated.

The embodiments 6 to 11 explained above can provide an active matrix liquid crystal display device capable of achieving a high definition and a high-speed drive without a large burden on the display device structure, and an active matrix liquid crystal display employing such device. Thus, there can be formed a flat display for direct observation or a projection display, of a high definition. Naturally it is also possible to construct a color television or a projection color television, by providing the pixels with different color filters, or by employing a plurality of the liquid crystal device adopting the driving method of the present invention and illuminating the devices with different colored lights.

FIG. 25 is a block diagram of an information signal processing system including the liquid crystal device of the present invention, wherein provided are a liquid crystal device 1 for displaying an image; a drive control circuit 2 for controlling the drive of the liquid crystal device and releasing the aforementioned resetting signal $\phi_{RES}$, resetting reference voltage $V_{RES}$, transfer signal $\phi_T$, image signal $S_{VI}$, and clock signal $\phi_{CLK}$ for driving the shift registers; an image input circuit 3 for reading image information from an original ORL bearing the image information by means of a photoelectric converting device 7; an information recording circuit 4 for recording the information on a recording medium RCM by means of a recording head 8, which can be an ink jet recording head or a thermal head in case the medium RCM is paper or a plastic sheet, or can be a magnetic head or an optical head in case the medium RCM is a magnetic tape, an optical disk or a magnetic disk; a communication circuit 5 for effecting communication with the outside through a channel NT; and a control circuit 6 for controlling the above-mentioned circuits, and provided with a known central processing unit CPU.

Figure 26:
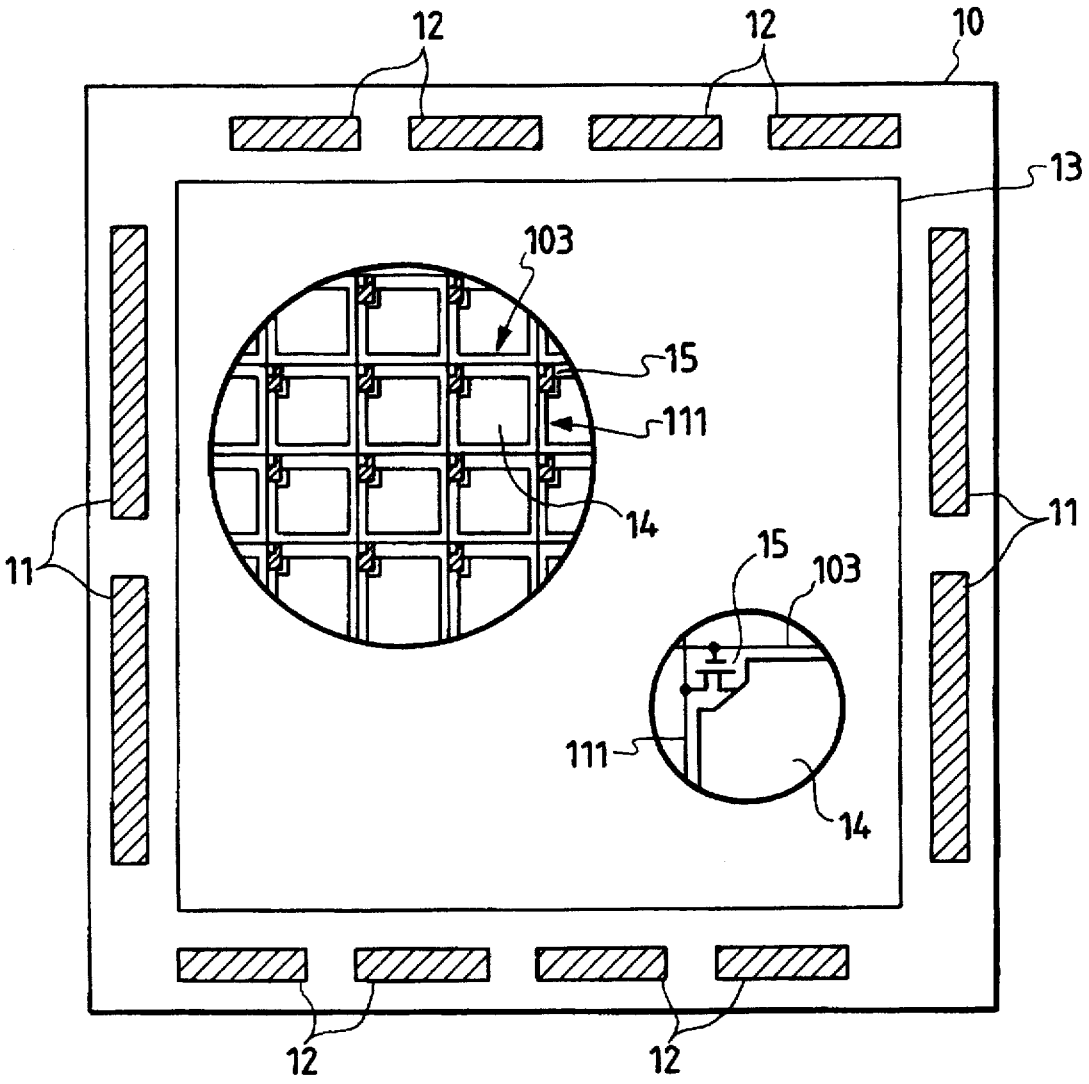
FIG. 26 schematically shows a liquid crystal element.

FIG. 26 illustrates a liquid crystal device, wherein included are a main frame 10; semiconductor integrated circuits 11 including the vertical shift register 108; semiconductor integrated circuits 12 including the horizontal shift register, buffer circuits and resetting circuits; and a liquid crystal display unit 13 containing a layer of a liquid crystal material between a pair of substrates, one of which bears matrix lines 103, 111, active elements 15, and individual pixel electrodes 14.

As explained in the foregoing, the present invention can provide a liquid crystal device capable of effecting high-speed drive and suppressing the smear in inexpensive manner.

What is claimed is:

1. A driving method for driving an active matrix type liquid crystal display device by a signal having a period in which an image signal is present and a blanking period which alternately repeats with the period in which the image signal is present, the display comprising: a plurality of unit cells each of which having: (i) an active element, (ii) a pixel electrode, and (iii) a liquid crystal material, the unit cells being arranged in a matrix form comprising a plurality of rows; and a plurality of signal lines for supplying signal voltage to the unit cells, the method comprising the steps of:

(a) supplying an image signal voltage to the unit cells during a part of the blanking period; and (b) after supplying the image signal voltage to the unit cells, and during a period before a termination of the blanking period, supplying a reset voltage to the signal lines, the period for supplying the reset voltage continuing for a time sufficient to charge a parasitic capacitance of the signal lines.

2. A method according to claim 1, wherein the active element comprises a thin film transistor.

* * * * *

UNITED STATES PATENT AND TRADEMARK OFFICE

CERTIFICATE OF CORRECTION

PATENT NO. : 5,694,145

DATED : December 2, 1997

INVENTOR(S): SHIGEKI KONDO ET AL.

It is certified that error appears in the above-identified patent and that said Letters Patent is hereby corrected as shown below:

In the Drawings:

ON SHEET 15

Figure 17, "PIXCEL" should read --PIXEL--.

ON SHEET 23

Figure 25, "PRIVING" should read --DRIVING--.

COLUMN 1

Line 4, "continuation," should read --continuation--;
Line 47, "pixels" should read --pixel--;
Line 51, "an" should be deleted.

COLUMN 3

Line 29, "said" should read --the--;
Line 32, "case the" should read --the case--;
Line 44, "the" should be deleted.

COLUMN 4

Line 13, "$\Delta V_2$" should read --$\Delta V_{CL2}$--.

COLUMN 5

Line 20, "parasite" should read --parasitic--;
Line 22, "parasite" should read --parasitic--;
Line 32, "to form" should be deleted--;
Line 51, "black" should read --white--.

UNITED STATES PATENT AND TRADEMARK OFFICE

CERTIFICATE OF CORRECTION

PATENT NO. : 5,694,145

DATED : December 2, 1997

INVENTOR(S): SHIGEKI KONDO ET AL.

It is certified that error appears in the above-identified patent and that said Letters Patent is hereby corrected as shown below:

COLUMN 7

Line 8, "as" should read --such as--.

COLUMN 8

Line 10, "units" should read --unit--;
Line 11, "units" should read --unit--.

COLUMN 9

Line 20, "device" should read --display device--.

COLUMN 10

Line 4, "said" should read --the--;
Line 41, "despite of" should read --despite--.

COLUMN 12

Line 20, "same" should read --the same--.

COLUMN 15

Line 53, "$T_B$" (first occurrence) should read --$T_{B1}$--;
Line 66, "employed-" should read --employed.--.

UNITED STATES PATENT AND TRADEMARK OFFICE

CERTIFICATE OF CORRECTION

PATENT NO. : 5,694,145

DATED : December 2, 1997

INVENTOR(S): SHIGEKI KONDO ET AL.

It is certified that error appears in the above-identified patent and that said Letters Patent is hereby corrected as shown below:

COLUMN 17

Line 39, "negligibly" should read --negligible--.

COLUMN 18

Line 28, "lines 103" (second occurrence) should be deleted;
Line 42, "only" should read --only in--;
Line 35, "TFT'S" should read --TFT's--;
Line 60, "parasitie" should read --parasitic--.

COLUMN 20

Line 25, "1" should read --10--;
Line 26, "1" should read --10--;
Line 35, "drive" should read --driven--.

UNITED STATES PATENT AND TRADEMARK OFFICE

CERTIFICATE OF CORRECTION

PATENT NO. : 5,694,145

DATED : December 2, 1997

INVENTOR(S) : SHIGEKI KONDO ET AL.

It is certified that error appears in the above-identified patent and that said Letters Patent is hereby corrected as shown below:

COLUMN 22

Line 29, "in" should read --in an--.

Signed and Sealed this

Twenty-sixth Day of May, 1998

Bruce Lehman

*Attest:*

BRUCE LEHMAN

*Attesting Officer*

*Commissioner of Patents and Trademarks*